US006569312B1

(12) United States Patent
Carroll et al.

(10) Patent No.: US 6,569,312 B1
(45) **Date of Patent: *May 27, 2003**

(54) INTEGRATED LUBRICANT UPGRADING PROCESS

(75) Inventors: Michael B. Carroll, Baton Rouge, LA (US); Fritz A. Smith, Doylestown, PA (US); John C. Bixel, Parker, CO (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/711,597

(22) Filed: Nov. 13, 2000

Related U.S. Application Data

(63) Continuation-in-part of application No. 09/162,517, filed on Sep. 29, 1998, now abandoned.

(51) Int. Cl.[7] ..... C10G 57/00; C10G 65/00; C10G 45/00; C10G 47/24

(52) U.S. Cl. ..... 208/49; 208/58; 208/27; 208/89; 208/108; 208/143; 208/254 R

(58) Field of Search ..... 208/58, 108, 254 R, 208/27, 89, 143, 49

(56) References Cited

U.S. PATENT DOCUMENTS

| | | | | | |
|---|---|---|---|---|---|
| 3,790,472 | A | * | 2/1974 | White | 208/111.15 |
| 4,414,097 | A | * | 11/1983 | Chester et al. | 208/59 |
| 5,122,257 | A | | 6/1992 | Van Helden et al. | 208/49 |
| 5,246,568 | A | | 9/1993 | Forbus et al. | 208/59 |
| 5,271,825 | A | | 12/1993 | Bortz et al. | 208/58 |
| 6,267,873 | B1 | | 7/2001 | Das et al. | 208/113 |
| 6,294,082 | B1 | | 9/2001 | Aldous et al. | 208/311 |

FOREIGN PATENT DOCUMENTS

| | | | |
|---|---|---|---|
| WO | WO01/81508 | 11/2001 | C10G/65/12 |

* cited by examiner

*Primary Examiner*—Walter D. Griffin
*Assistant Examiner*—Tam M. Nguyen
(74) *Attorney, Agent, or Firm*—Jeremy J. Kliebert

(57) ABSTRACT

A process for upgrading oil feedstock wherein the feedstock is hydrocracked, flashed and/or distilled. The bottoms are then vacuum distilled to adjust viscosity and volatility. The refined feed is then dewaxed under high pressure by a medium pore molecular sieve. The dewaxed material is then cascaded to a hydrofinishing step, where it is contacted with an aromatics saturation catalyst having a metal hydrogenation function in order to produce, after appropriate flashing and distillation, lubricant products having high Viscosity Index, low aromatics content, low volatility and excellent stability to light in the presence of oxygen.

26 Claims, 24 Drawing Sheets

Figure 1:
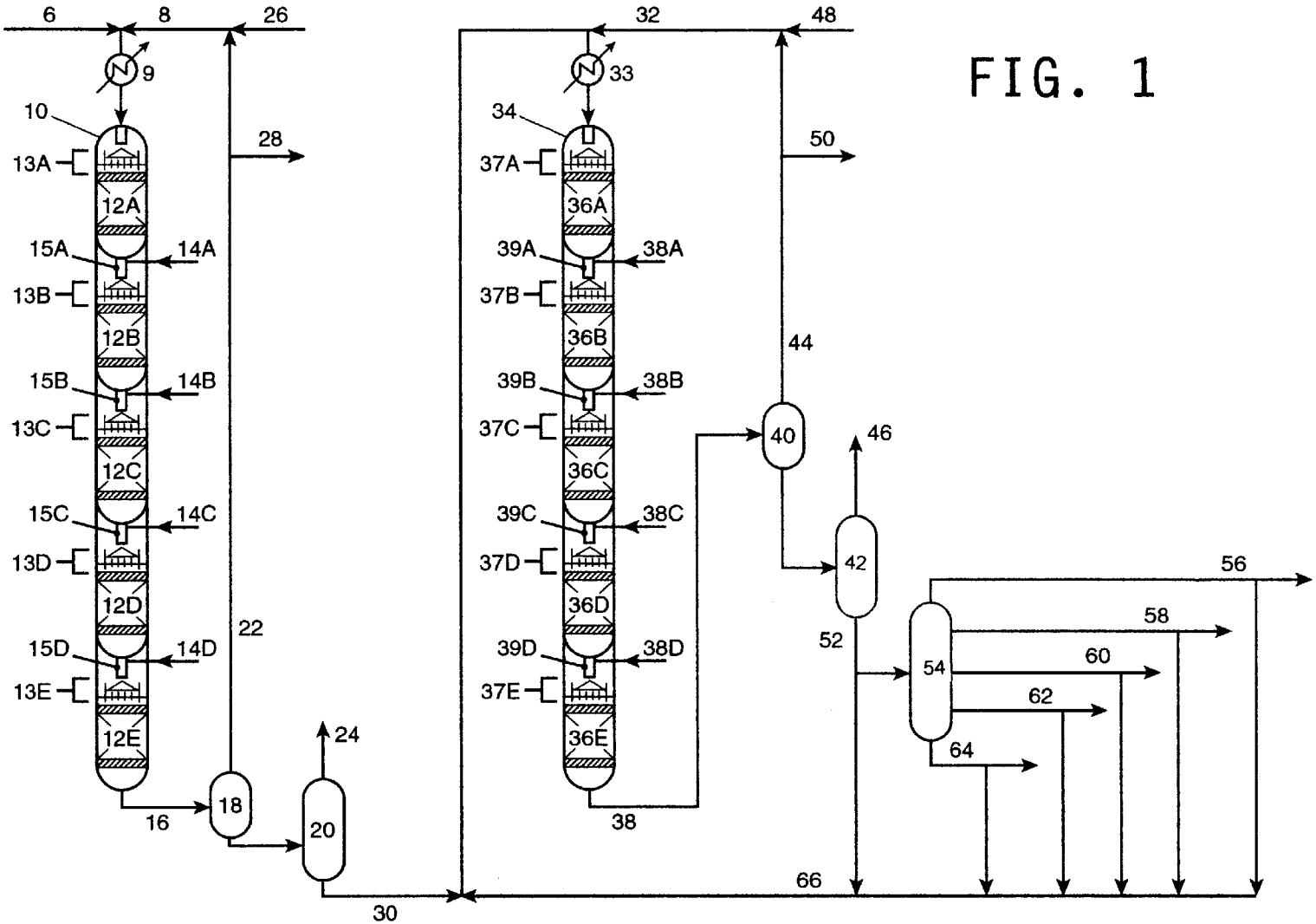

| | |
|---|---|
| W | WAXY CHARGE |
| S | SOLVENT DEWAXING (dry wax basis) |
| | MLDW: Std HDF Cat @ 400 psig |
| □ | 465°F HDF |
| ◇ | 500°F HDF |
| △ | 550°F HDF |
| | MLDW: Std HDF Cat @ 2200 psig |
| ○ | 500°F HDF |
| | MLDW: Arosat HDF Cat @ 2500 psig |
| ■ | 450°F HDF |
| ◆ | 525°F HDF |
| ▲ | 575°F HDF |
| ● | 625°F HDF |

| | |
|---|---|
| W | WAXY CHARGE |
| | MLDW: Std HDF Cat @ 400 psig |
| ◇ | 500°F HDF |
| △ | 550°F HDF |
| | MLDW: Arosat HDF Cat @ 2500 psig |
| ■ | 450°F HDF |
| ◆ | 525°F HDF |
| — — — | BEST FIT LINE |

Total aromatics determined using HPLC separation with high sensitivity light scattering mass detector

| | LHSV | 0.2% Pt/ ZSM-23°C | 0.2% Pt/ ZSM-23°C | 0.2% Pt/ ZSM-23°C |
|---|---|---|---|---|
| ■ | 1 | 317 | 218 | 28.1 |
| ✳ | 1 | 328 | 218 | 154.7 |
| ◇ | 1 | 334 | 218 | 28.1 |
| F | Waxy Feed | | | |
| — — — | Correlation | | | |

UV Absorptivity @ 226 nm can be correlated with Total Aromatics Content for a given family of hydrofinished lub stocks. It is especially useful at very low aromatics where the repeatability of aromatics analysis becomes poor.

INTEGRATED LUBRICANT UPGRADING PROCESS

CROSS-REFERENCE TO RELATED APPLICATIONS

This application is a continuation-in-part of application Ser. No. 09/162,517 filed Sep. 29, 1998 now abandoned and is related to application Ser. No. 08/557,470, filed Nov. 14, 1995 now abandoned and priority is claimed from this date under 37 C.F.R. 1.78(a)(2).

FIELD OF THIS INVENTION

This invention relates to the hydrocracking and subsequent catalytic dewaxing of petroleum chargestocks. In particular, it relates to an integrated fuels hydroprocessing scheme which comprises hydrocracking, distillation, catalytic dewaxing and hydrofinishing steps.

BACKGROUND OF THE INVENTION

Mineral oil lubricants are derived from various crude oil stocks by a variety of refining processes directed towards obtaining a lubricant base stock of suitable boiling point, viscosity, pour point, viscosity index (VI), stability, volatility and other characteristics. Generally, the base stock will be produced from the crude oil by distillation of the crude in atmospheric and vacuum distillation towers, followed by the removal of undesirable aromatic components by means of solvent refining and finally, by dewaxing and various finishing steps. Because multi-ring aromatic components lead to poor thermal and light stability, poor color and extremely poor viscosity indices, the use of crudes of low hydrogen content or asphaltic type crudes is not preferred as the yield of acceptable lube stocks will be extremely low after the large quantities of aromatic components contained in the lubestocks from such crudes have been separated out. Paraffinic and naphthenic crude stocks are therefore preferred but aromatic treatment procedures are necessary with feedstocks which contain polynuclear aromatics in order to remove undesirable aromatic components.

In the case of the lubricant distillate fractions, generally referred to as the neutrals, e.g. heavy neutral, light neutral, etc., the aromatics may be extracted by solvent extraction using a solvent such as furfural, n-methyl-2-pyrrolidone, phenol or another chemical which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

U.S. Pat. No. 5,275,719 (Baker et al, hereinafter "Baker") disclosed a process for producing a high viscosity index lubricant which possesses a VI of at least 140 from a hydrocarbon feed of mineral oil origin which contains nitrogen compounds and has a wax content of at least 50wt % wherein the feed is hydrocracked in an initial stage. A preferred feed in Baker is slack wax, which typically possesses a paraffin content as great as 70% as illustrated by Table 1.

TABLE 1

SLACK WAX PROPERTIES IN GENERAL

| | |
|---|---|
| API | 39 |
| Hydrogen, wt. pct. | 15.14 |
| Sulfur, wt. pct. | 0.18 |
| Nitrogen, ppmw | 11 |
| Melting point, ° C. (° F.) | 57 (135) |
| KV at 100° C., cSt | 5.168 |
| PNA, wt pct: | |
| Paraffins | 70.3 |
| Naphthenes | 13.6 |
| Aromatics | 16.3 |
| Simulated distillation: | |
| % | ° C. (° F.) |
| 5 | 375 (710) |
| 10 | 413 (775) |
| 30 | 440 (825) |
| 50 | 460 (860) |
| 70 | 482 (900) |
| 90 | 500 (932) |
| 95 | |

A fuels hydrocracking process with partial liquid recycle is disclosed in U.S. Pat. No. 4,983,273 (Kennedy et al.). In this the feed (usually vacuum gas oil (VGO) or light cycle oil (LCO)) is processed in a hydrotreating reactor, then in a hydrocracking reactor prior to being passed to a fractionator. A portion of the fractionator bottoms is then recycled to the hydrocracker. Yukong Limited has disclosed (International Application PCT/KR94/00046, U.S. Pat. No. 5,580,442) a method for producing feedstocks of high quality lube base oil from unconverted oil (UCO) of a fuels hydrocracker operating in recycle mode.

Catalytic dewaxing processes are becoming favored for the production of lubricating oil stocks. They possess a number of advantages over the conventional solvent dewaxing procedures. The catalytic dewaxing processes operate by selectively cracking the normal and slightly branched waxy paraffins to produce lower molecular weight products which may then be removed by distillation from the higher boiling lube stock. Concurrently with selective catalytic cracking of waxy molecules, hydroisomerization with the same or different catalyst can convert a significant amount of linear molecules to branched hydrocarbon structure having improved cold-flow properties. A subsequent hydrofinishing or hydrotreating step is commonly used to stabilize the product by saturating lube boiling range olefins produced by the selective cracking which takes place during the dewaxing. Reference is made to U.S. Pat. No. 3,894,938 (Gorring et al.), U.S. Pat. No. 4,181,598 (Gillespie et al.), U.S. Pat. No. 4,360,419 (Miller), U.S. Pat. No. 5,246,568 (Kyan et al.) and U.S. Pat. No. 5,282,958 (Santilli et al.) for descriptions of such processes. *Hydrocarbon Processing (September* 1986) refers to Mobil Lube Dewaxing Process, which process is also described in Chen et al "Industrial Application of Shape-Selective Catalysis" *Catal. Rev.-Sci. Eng.* 28 (283), 185–264 (1986), to which reference is made for a further description of the process. See also, "Lube Dewaxing Technology and Economics", *Hydrocarbon Asia* 4 (8), 54–70 (1994).

In catalytic dewaxing processes of this kind, the catalyst becomes progressively deactivated as the dewaxing cycle progresses. To compensate for this, the temperature of the dewaxing reactor is progressively raised in order to meet the target pour point for the product. There is a limit, however, to which the temperature can be raised before the properties of the product become unacceptable. For this reason, the catalytic dewaxing process is usually operated in cycles with the temperature being raised in the course of the cycle from a low start-of-cycle (SOC) value, typically in the range of about 450° F. to 525° F. (about 232° C. to 274° C.), to a final, end-of-cycle (EOC) value, typically about 670–725° F. (about 354–385° C.), after which the catalyst is reactivated or regenerated for a new cycle. Typically, dewaxing catalysts which employ ZSM-5 as the active ingredient may be reactivated by hot hydrogen. Other dewaxing catalysts may be decoked using air, or oxygen in combination with $N_2$ or flue gas. Catalysts which contain active ingredients, such as ZSM-23 or SAPO-11, that are less active than ZSM-5 containing catalysts may have start-of-cycle (SOC) and end-of-cycle (EOC) temperatures that are 25 to 50° C. higher than those that contain ZSM-5.

The use of a metal hydrogenation component on the dewaxing catalyst has been described as a highly desirable expedient, both from obtaining extended dewaxing cycle duration and for improving the reactivation procedure. U.S. Pat. No. 4,683,052 discloses the use of noble metal components e.g. Pt or Pd as superior to base metals such as nickel for this purpose. A suitable catalyst for dewaxing and isomerizing or hydro-isomerizing feedstocks may contain 0.1–0.6, wt. % Pt, for instance, as described in U.S. Pat. Nos. 5,282,958; 4,859,311; 4,689,138; 4,710,485; 4,859,312; 4,921,594; 4,943,424; 5,082,986; 5,135,638; 5,149,421; 5,246,566; 4,689,138.

Chemical reactions between liquid and gaseous reactants present difficulties in obtaining intimate contact between phases. Such reactions are further complicated when the desired reaction is catalytic and requires contact of both fluid phases with a solid catalyst. In the operation of conventional concurrent multiphase reactors, the gas and liquid under certain circumstances tend to travel different flow paths. The gas phase can flow in the direction of least pressure resistance; whereas the liquid phase flows by gravity in a trickle path over and around the catalyst particles. Under conditions of low liquid to gas ratios, parallel channel flow and gas frictional drag can make the liquid flow non-uniformly, thus leaving portions of the catalyst bed underutilized due to lack of adequate wetting. Under these circumstances, commercial reactor performance can be much poorer than expected from laboratory studies in which flow conditions in small pilot units can be more uniform.

In refining of lubricants derived from petroleum by fractionation of crude oil, a series of catalytic reactions may be employed for severely hydrotreating, converting and removing sulfur and nitrogen contaminants, hydrocracking and isomerizing components of the lubricant charge stock in one or more catalytic reactors. Polynuclear aromatic feedstocks may be selectively hydrocracked by known techniques to open polynuclear rings. This can be followed by hydrodewaxing and/or hydrogenation (mild hydrotreating) in contact with different catalysts under varying reaction conditions. An integrated three-step lube refining process is disclosed by Garwood et al, in U.S. Pat. No. 4,283,271.

In a typical multi-phase hydrodewaxing reactor, the average gas-liquid volume ratio in the catalyst zone is about 1:4 to 20:1 under process conditions. Preferably the liquid is supplied to the catalyst bed at a rate to occupy about 10 to 50% of the void volume. The volume of gas may decrease due to the depletion of reaction $H_2$ as the liquid feedstock and gas pass through the reactor. Production of vapors from formation of methane, ethane, propane and butane from the dewaxing reactions, adiabatic heating or expansion can also affect the volume.

SUMMARY OF THE INVENTION

An improved, integrated process for hydrocracking and hydrodewaxing high-boiling paraffinic wax-containing liquid petroleum lubricant oil chargestocks has now been found. Vacuum gas oils, light cycle oils or even deasphalted oils as well as other feedstocks may be hydrocracked in a fuels hydrocracker scheme which comprises a downstream vacuum distillation unit. Catalytic dewaxer feedstocks having hydrogen about 13.5 wt. % are produced from the fuels hydrocracker and subsequently dewaxed, hydrofinished and distilled. At least 30 wt. % of the feedstock is converted to hydrocarbon products which boil below the initial boiling point of the feedstock. The improved process for producing lubricating oils from lubricating oil feedstocks comprises the steps of:

(a) passing the feedstock, to a fuels hydrocracker under hydrocracking conditions to produce a hydrocracked feedstock, wherein at least about 30 wt. % of the feedstock is converted to hydrocarbon products which boil below the initial boiling point of the feedstock;

(b) passing at least a portion of the hydrocracked feedstock to a separation zone and separating gases, a converted hydrocracked fraction containing distillates boiling up to the diesel range and an unconverted hydrocracked fraction;

(c) passing at least a portion of the unconverted hydrocracked fraction to a vacuum distillation zone and isolating at least two fractions;

(d) hydrodewaxing at least one fraction from the vacuum distillation zone in a catalytic dewaxing zone under catalytic dewaxing conditions to produce at least one dewaxed fraction, wherein the catalytic dewaxing conditions include a shape selective, medium pore molecular sieve catalyst; and (e) hydrofinishing the at least one dewaxed fraction in a hydrofinishing zone under hydrofinishing conditions, said hydrofinishing zone including an aromatics saturation catalyst having metal hydrogenation function, to produce lubricating oils.

In another embodiment, the process of the invention for producing lubricating oils from a lubricating oil feedstock comprises the steps of:

(a) passing the feedstock to a hydrotreating zone and hydrotreating the feedstock under hydrotreating conditions to produce a hydrotreated feedstock;

(b) passing at least a portion of the hydrotreated feedstock to a hydrocracking zone and hydrocracking the hydrotreated feedstock under hydrocracking conditions to produce a hydrocracked feedstock, wherein at least about 30 wt. % of the feedstock is converted in the hydrotreating/hydrocracking zones to hydrocarbon products which boil below the initial boiling point of the feedstock;

(c) passing at least a portion of the hydrocracked feedstock to a separation zone and separating gases, a converted hydrocracked fraction containing distillates boiling up to the diesel range, and an unconverted hydrocracked fraction;

(d) passing at least a portion of the unconverted hydrocracked fraction to a vacuum distillation zone and isolating at least two fractions;

(e) hydrodewaxing at least one fraction from the vacuum distillation zone in a catalytic dewaxing zone under catalytic dewaxing conditions to produce at least one dewaxed fraction, wherein the catalytic dewaxing conditions include a shape selective, medium pore molecular sieve catalyst; and (f) hydrofinishing the at least one dewaxed fraction in a hydrofinishing zone under hydrofinishing conditions, said hydrofinishing zone including an aromatics saturation catalyst having metal hydrogenation function, to produce lubricating oils.

After subsequent distillation, the dewaxed oil product has less than 10 wt. %, preferably less than 5 wt. % aromatics and enhanced oxidative stability, UV light stability and thermal stability. The product possesses a NOACK volatility of 30 wt. %, preferably 20 wt. % or lower and a VI of 105 or higher, preferably 115 or higher. Viscosities are in the range from 2 to 12 cSt at 100° C., preferably 3 to 10 cSt at 100° C. NOACK volatility can be measured by ASTM D5800–95.

The preferred hydrodewaxing catalyst comprises a molecular sieve having pores comprised of 10 oxygen atoms alternating with predominately silicon atoms, such as aluminosilicate zeolites having the structure of ZSM-5, ZSM-23, ZSM-35 or ZSM-48. Other non-zeolitic molecular sieves, such as SAPO-11, having similar pore size are also suitable catalysts. With the exception of ZSM-5, it is desirable that the catalyst comprise from 0.1 to 1.2 wt. % noble metal. In the instant invention, 0.2 to 1 wt. % Pt and/or Pd is preferred.

The preferred hydrofinishing catalyst to be employed subsequent to dewaxing comprises at least one Group VIIIA metal and one Group VIA metal (IUPAC) on a porous solid support such as Pt and/or Pd on a porous solid support. A bimetallic catalyst containing nickel and tungsten metals on a porous alumina support is a good example. The support may be fluorided.

As previously indicated, preferred feeds to the fuels hydrocracker are virgin gas oils, such as light vacuum gas oil (LVGO), vacuum gas oil (VGO) and heavy vacuum gas oil (HVGO). VGO and HVGO normally contain significant levels of polycyclic aromatics. Vacuum gas oil or light cycle oil typically possess paraffin contents of less than 30 wt. %, as illustrated in Table 2.

TABLE 2

| VGO Properties in General | |
|---|---|
| API Gravity | 23.2 |
| Distillation. wt. pct. | |
| 225–345° C. (437–653° F.) | 7.0 |
| 345–400° C. (653–752° F.) | 17.0 |
| 400° C.+ (752° F.+) | 76.0 |
| Sulfur, wt. pct. | 2.28 |
| Nitrogen, ppmw | 550 |
| Pour Point, ° C. (° F.) | 18 (95) |
| KV at 100° C., cSt | 5.6 |
| P/N/A, wt. pct. | 29/21/50 |

After hydrocracking, and vacuum distillation the waxy material is catalytically dewaxed. The hydrodewaxed effluent is hydrofinished and distilled, then is separated to recover a lubricant product which boils above 370° C. (698° F.) having kinematic viscosity (KV) in the range from 2 to 12 cSt at 100° C. The product lube oil has good UV light stability and an aromatics content of 10, preferably 5 wt. % or lower. Advantageously, the dewaxing stage and hydrofinishing stage are operated at substantially the same pressure, and the entire dewaxed oil stream from the dewaxing stage can be passed directly to the hydrofinishing stage in a cascade operation.

A dewaxed product of improved viscosity index, stability, color and lower volatility is produced. The hydrocracker increases the hydrogen content, reduces the viscosity and lowers the boiling range of the hydrocracker charge stock. The catalytic dewaxer selectively cracks and/or hydroisomerizes the waxy hydrocrackate. The hydrofinisher hydrogenates aromatics and olefins, and reduces the ultraviolet light absorptivity of the dewaxed oil. Distillation is used to adjust volatility. The resulting lube base. oil product is colorless, has low aromatics content, low pour point, improved cold flow properties, high viscosity index, low volatility and excellent oxidation stability.

THE DRAWINGS

FIG. 1 is a schematic diagram of a fuels hydrocracker suitable for use in the instant invention. A hydrotreater, hydrocracker, separator, vacuum distillation unit and hydrofinisher are illustrated. Unconverted material from the fractionation unit may be recycle to the hydrocracker or may be sent to the vacuum distillation unit to be appropriately cut for feed to the catalytic dewaxing reactor.

Figure 2:
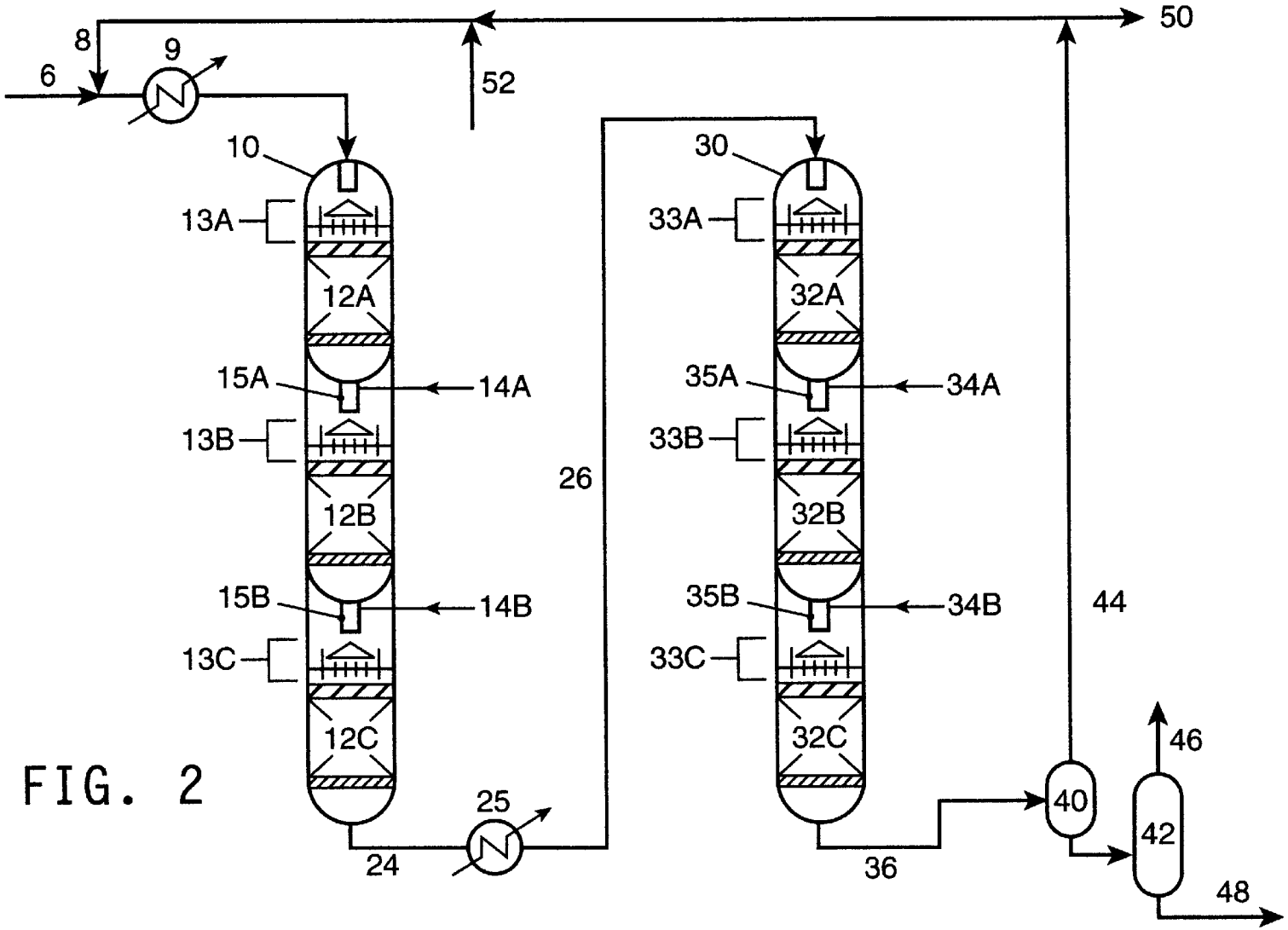
Figure 3:
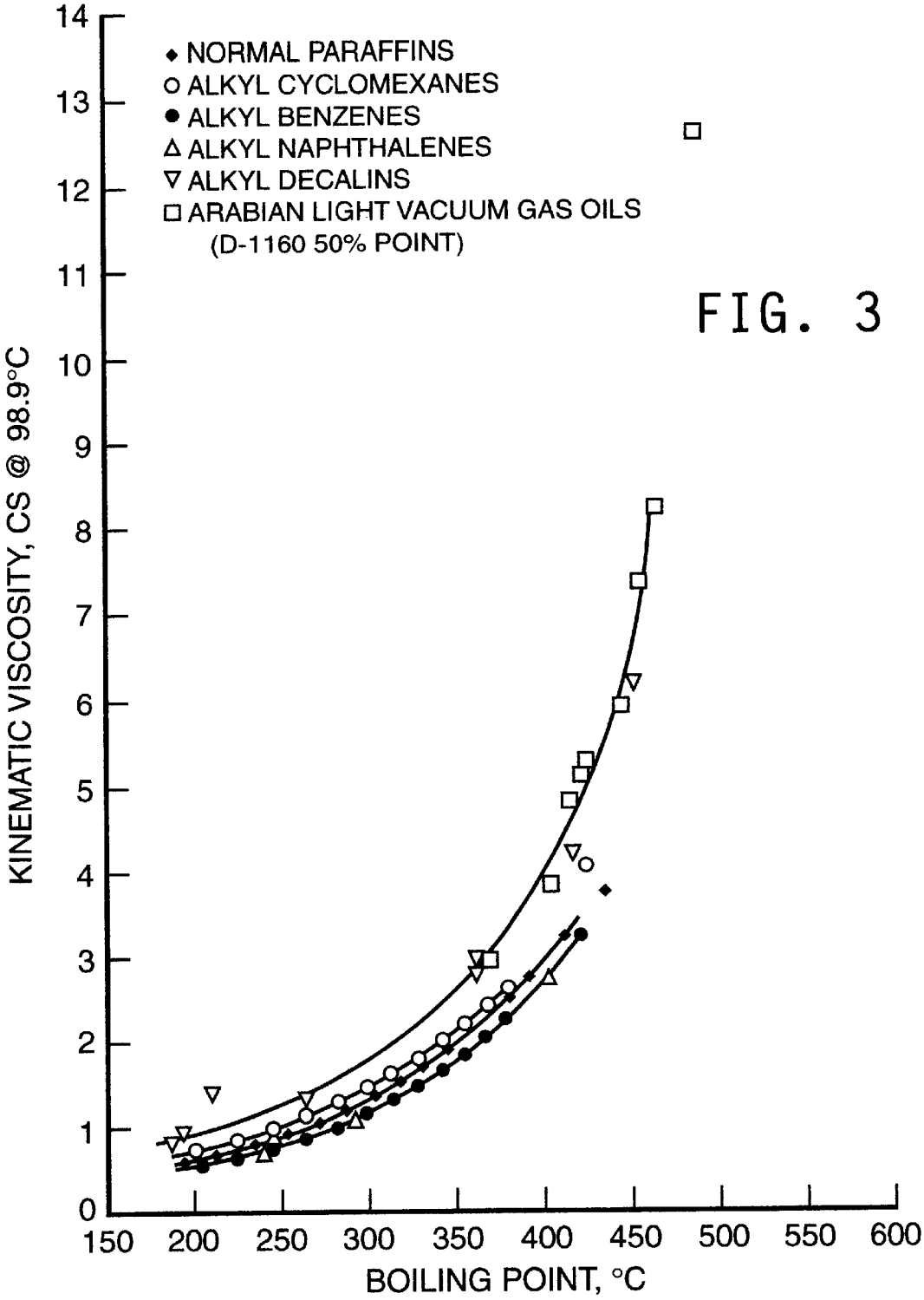

FIG. 2 is a simplified diagram showing a series of vertical reactors with fixed catalyst beds, showing major flow streams;

FIG. 3 demonstrates the relationship between boiling point and viscosity for pure components and vacuum gas oils from Arab light crude.

Figure 4:
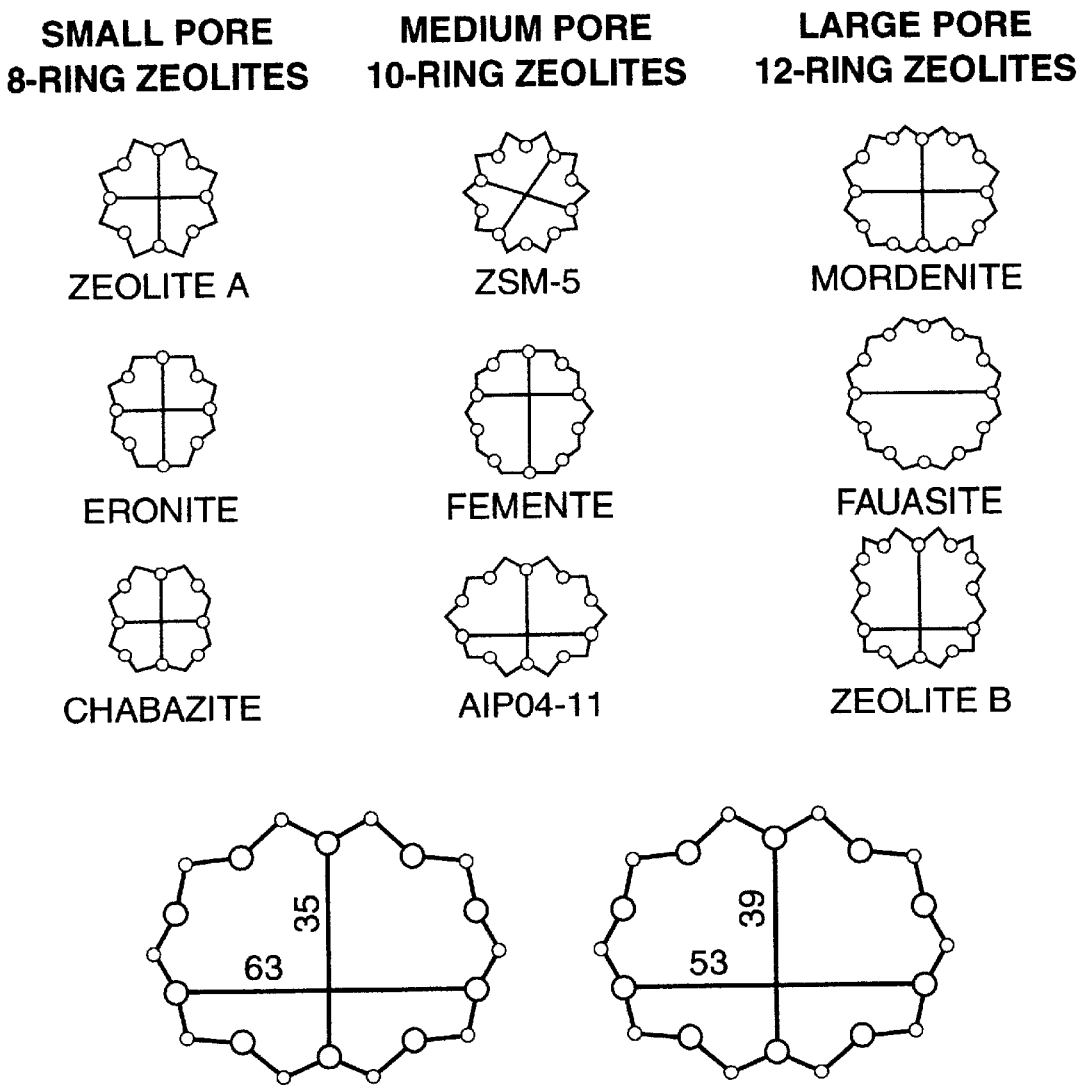

FIG. 4 presents a comparison of the features of small pore, medium pore and large pore zeolites, or molecular sieves.

FIGS. 5 through 24 are graphic plots of product properties comparing various process parameters for the improved process and lube products.

DETAILED DESCRIPTION OF THE INVENTION

Lubricant base stocks of high viscosity index (VI) may be manufactured by the processing of fuels hydrocracker bottoms. This route provides the potential for the manufacture of base stocks with VI of 105 or greater. The fuels hydrocracking scheme of the instant invention not only improves VI, but provides a means to meet new international guidelines regarding lower volatility base stocks e.g., ILSAC GF-2 or GF-3. The newly proposed volatility requirements require the removal of lighter, lower boiling lube fractions than currently practiced in vacuum distillation procedures for the preparation of lubricant basestocks and this increases their viscosity. Consequently, higher boiling, higher viscosity material must also be removed in the distillation procedures in order to maintain viscosity. This generally leads to lower yields and narrower cuts of lube bascstocks. Distillation of the hydrocracker bottoms, as disclosed in the instant invention can also improve the operability and efficiency of a hydrocracker using bottoms recycle by removing undesirable components such as polynuclear aromatics in the lubes fraction. The resulting lube range fractions may be catalytically dewaxed, hydrotreated, then distilled to produce the final lubricant product. In the following description, units are metric unless otherwise indicated.

I. Feedstock to the Integrated Process—Overview

The hydrocarbon feedstock to the integrated process of this invention is a lube range feed with an initial boiling point and final boiling point selected to produce a lube stock of suitable lubricating characteristics. These feedstocks are typically hydrocarbons having a 10% distillation point greater than 345° C. (653° F.) and a viscosity of from about 3 to about 40 centistokes at 100° C. as can be determined from FIG. 3 or similar correlations. The feed is conventionally produced by the vacuum distillation of a fraction from a crude source of suitable type. Generally, the crude will be subjected to an atmospheric distillation and the atmospheric residuum (long resid) will be subjected to vacuum distillation to produce the initial unrefined lube stocks. The vacuum distillate stocks or "neutral" stocks and bright stocks from propane deasphalting the vacuum distillation bottoms are used to produce a range of viscosity products. In conventional solvent refining lube plants, the feedstocks are subjected to solvent extraction to improve their VI and other qualities by selective removal of the aromatics using a solvent which is selective for aromatics such a furfural, phenol, or n-methyl-pyrrolidone. In the invention, the feed is subjected to hydrocracking prior to dewaxing and hydrofinishing to obtain the desired product characteristics.

The unrefined vacuum distillates and propane deasphalted oils (DAO) are refined by hydrocracking or severe hydrotreating to convert undesirable aromatic and heterocyclic compounds to more desirable naphthenes and paraffins. (See Example 3 infra). These refined waxy mixtures are low in sulfur and nitrogen contents and may be adjusted for viscosity by distillation as described earlier.

Integrated all-catalytic lubricant production processes employing hydrocracking and catalytic dewaxing are described in U.S. Pat. No. 4,414,097 (Chester et al.), U.S. Pat. No. 4,283,271 (Garwood et al.), U.S. Pat. No. 4,283,272 (Garwood et al.), U.S. Pat. No. 4,383,913 (Powell et al.), U.S. Pat. No. 4,347,121 (Mayer et al.), U.S. Pat. No. 3,684,695 (Neel et al.) and U.S. Pat. No. 3,755,145 (Orkin).

II. Hydrocracking Step

A. Feed to Hydrotreating/Hydrocracking System

The hydrocracking process operates with a heavy hydrocarbon feedstock including distillates such as virgin light vacuum gas oil and heavy vacuum gas oil, raffinates and deasphalted oils, extracts, slack waxes, soft waxes (e.g. foots oils), or combination of these, all boiling above about 340° C. Although these virgin oils are preferred, cracked stocks such as light and heavy coker gas oils and light and heavy FCC gas oils may be added. Because lube oils are generally sold according to their viscosities and because hydrocracking reduces viscosity, the feedstocks to the hydrocracker preferably have a kinematic viscosity at 100° C., of 3 cSt or greater. This means that the preferred boiling range is above 340° C. (see FIG. 3, infra which shows a correlation of 50% boiling points and viscosities for pure components and vacuum gas oils from Arab light crude). Feedstocks boiling below 340° C. may be included in the hydrocracker feed, but their even lighter products will be removed in the separator 20. (See FIG. 1.) These heavy oils comprise high molecular weight long chain paraffins and high molecular with naphthenes and aromatics. The feed to the hydrotreating/hydrocracking system may contain less than 50 wt. % paraffins. The aromatics will include some fused ring aromatics which are detrimental to lube oils stability. During the processing, the fused ring aromatics and naphthenes are cracked by the acidic catalyst and the paraffinic cracking products, together with paraffinic components of the initial feedstock, undergo conversion to iso-paraffins with some cracking to lower molecular weight materials. Hydrogenation of the polycyclic aromatics is catalyzed by the hydrogenation component and facilitates cracking of these compounds. Hydrogenation of unsaturated side chains on the monocyclic cracking residues of the original polycyclic compounds provides substituted monocyclic aromatics which are highly desirable end products. The heavy hydrocarbon oil feedstock will normally contains a substantial amount boiling about 340° C. (644° F.) and have a viscosity about 3cSt at 100° C. It will normally have an initial boiling point above about 400° C. (752° F.) and more usually above about 450° C. (842° F.). The boiling range may be as broad as 340–700° C. (644–1292° C. with a narrower boiling range may of course, be processed, for example, those with a boiling range of about 400 to 500° C. (about 752° F. to 932° F.). Heavy gas oils are often of this kind as are cycle oils and other non-residual materials. Cycle oils from catalytic cracking operations (FCC) and coking operations are not particularly useful as sole feed components for producing lube oils because they are so highly unsaturated but they may be blended into the virgin oils described above as long as they meet the same boiling and viscosity requirements described for the virgin oils.

The preliminary hydrotreating step using a conventional hydrotreating catalyst to remove nitrogen and sulfur and to saturate aromatics to naphthenes without substantial boiling range conversion will usually improve catalyst performance and permit lower temperatures, higher space velocities, lower pressures or combinations of these conditions to be employed. Suitable hydrotreating catalysts generally comprise a metal hydrogcnation component, usually a group VIB, or VIII metal as described above e.g. cobalt-molybdenum, nickel-molybdenum, on a substantially non-acidic porous support e.g. silica-alumina or alumina. These are listed in Table 3.

TABLE 3

Catalysts suitable for use in preliminary hydrotreating step

| VENDOR | CATALYST | TYPE |
|---|---|---|
| UOP | HCH | $NiMo/Al_2O_3$ |
| Crosfield | 594 | $NiMo/Al_2O_3$ |
| Crosfield | 504-K | $NiMo/Al_2O_3$ |
| Criterion | HDN60 | $NiMo/Al_2O_3$ |
| Criterion | C-411 | $NiMo/Al_2O_3$ |
| Criterion | C-424 | $NiMo/Al_2O_3$ |
| Criterion | DN-190 | $NiMo/Al_2O_3$ |
| Acreon | HR348 | $NiMo/Al_2O_3$ |
| Acreon | HR360 | $NiMo/Al_2O_3$ |
| Akzo | KF848 | $NiMo/Al_2O_3$ |
| Akzo | KF846 | $NiMo/Al_2O_3$ |

Other suitable hydrotreating catalysts include bulk metal catalysts such as those containing 30 wt. % or more metals (as metal oxides), based on catalyst, preferably greater than 40 wt. %, more preferably greater than 50 wt. % of metals, based on catalyst wherein the metals include at least one Group VIB or Group VIII metal.

Conventional hydrotreating conditions include temperatures of from 2500 to 450° C., hydrogen partial pressures of from 800 to 3000 psia, liquid hourly space velocities of from 0.1 to 10 $h^{-1}$, and hydrogen treat gas rates of from 500 to 10000 SCF/B (90 to 1780 $Nm^3/m^3$).

II.B Description of the Preferred Embodiment

FIG. 1 is a simplified illustration of the preferred reactor system for the fuels hydrocracker of this invention. A preliminary hydrotreating step using a conventional hydrotreating catalyst to remove nitrogen, sulfur, and oxygen and to saturate olefins and aromatics without substantial boiling range conversion will usually improve the hydrocracking catalyst performance and permit higher space velocities, lower pressures, or combinations of these conditions to be employed. Suitable hydrotreating catalysts generally comprise a metal hydrogenation component, usually from Groups VIII and VIB, such as cobalt-molybdenum or nickel molybdenum, on a low-acidity porous support such as silica-alumina or alumina. Appropriate commercial hydrotreating catalysts suitable for use in the instant invention include alumina supported nickel-molybdenum catalysts, such as UOP HCH, Crosfield 594, and Criterion HDN60, and USY supported nickel-molybdenum catalysts, such as UOP I-IC-24.

A vertical reactor shell 10 encloses and supports a stacked series of fixed porous solid beds of hydrotreating catalyst, as depicted by 12A through 12E. A chargestock 6 comprising vacuum gas oil, light cycle oil, deasphalted oil or any combination of these is combined with a hydrogen-rich gas 8 and introduced to the reactor 10 after undergoing appropriate heating means 9. The combined chargestock and hydrogen-rich gas flow downwardly through the catalyst beds. Although 5 beds are depicted in this example, there may be more beds or as few as two. Liquid distribution in each bed is achieved by any conventional technique, such as distributor trays 13A, B, C, D, E, which project the liquid uniformly onto the catalyst bed surfaces 12A, B, C, D, E. Typically the gas and liquid phases are introduced into the reactor at a desired inlet pressure and temperature. The gas and liquid temperature may be adjusted between catalyst beds by the addition of hydrogen-rich quench gas 14A, B, C, D or alternatively by heat exchange of the liquid in an external flow loop, thereby allowing independent control of the temperature in any catalyst bed. A static mixer 15A, B, C, D or other suitable contacting device may be used to mix the liquid and gas streams between catalyst zones, including quench gas, to obtain a homogeneous temperature.

The hydrotreater effluent 16 passes through heat exchangers (not shown), separators 18, and stripping or fractionation equipment 20 to separate a recycle gas stream 22 and light conversion products 24. These separations remove byproduct $NH_3$ and $H_2S$, which would otherwise poison the hydrocracking catalyst downstream. A purge gas stream 28 would typically be withdrawn from the recycle gas to remove light hydrocarbon products. Gas scrubbing facilities (not shown) would typically be used to remove $NH_3$ and $H_2S$ from the recycle gas stream. Makeup hydrogen 26 is added to compensate for hydrogen consumed in the hydrotreating reactions and purged in the gas and liquid product streams 28, 24, and 30.

Alternatively, hydrotreater effluent 16 may be passed directly to reactor 34 without added hydrogen and without passing through stripper 18 and fractionator 20 (without disengagement) provided that the catalyst in reactor 34 can tolerate an environment containing ammonia and hydrogen sulfide.

A vertical reactor shell 34 encloses and supports a stacked series of fixed porous solid beds of hydrocracking catalyst, as depicted by 36A through 36E. The hydrocracking catalyst, which may be more than one catalyst, either admixed or in separate beds, is discussed infra. The hydrotreater bottoms product 30 is combined with a hydrogen-rich gas 32 and introduced to the hydrocracking reactor 34 after undergoing appropriate heating means 33. The combined chargestock and hydrogen-rich gas flow downwardly through the catalyst beds. Although 5 beds are depicted in this example, there may be more beds or as few as two. Liquid distribution in each bed is achieved by any conventional technique, such as distributor trays 37A, B, C, D, E, which project the liquid uniformly onto the catalyst bed surfaces 36A, B, C, D, E. Typically the gas and liquid phases are introduced into the reactor at a desired inlet pressure and temperature. The gas and liquid temperature may be adjusted between catalyst beds by the addition of hydrogen-rich quench gas 38A, B, C, D, or alternatively by heat exchange of the liquid in an external flow loop, thereby allowing independent control of the temperature in any catalyst bed. A static mixer 39A, B, C, D or other suitable contacting device may be used to mix the liquid and gas streams between catalyst zones, including quench gas, to obtain a homogeneous temperature.

The hydrocracker effluent 38 passes through heat exchangers (not shown), separators 40 and fractionation equipment 42 to separate a recycle gas stream 44 and converted hydrocracked fractions 46. The hydrocracked fraction 46 includes distillates boiling in the gasoline range and the diesel range. The diesel range fraction may be dewaxed and hydrofinished in the same manner as lube fractions 56–64. A purge gas stream 50 would typically be withdrawn from the recycle gas to remove light hydrocarbon products. Gas scrubbing facilities (not shown) would typically be used to remove $NH_3$ and $H_2S$ from the recycle gas stream. Makeup hydrogen 48 is added to compensate for hydrogen consumed in the hydrocracking reactions and purged in the gas and liquid product streams 50 and 46. The unconverted bottoms product 52, proceeds to the lube vacuum distillation unit 54, one of the novel features of the instant invention. This additional distillation step enables the production of various narrow lube fractions 56, 58, 60, 62, 64 of specific viscosity (e.g. 60N, 100N, 150N) and volatility. In the case of a light lube fraction having the viscosity of about a 60N base oil, this fraction may be hydrotreated under conventional hydrotreating conditions prior to dewaxing. Low volatility lube stocks with VI or at least 105 can be produced. Although five lube cuts are shown, there may be more or as few as two. These lube fractions, are passed from the vacuum distillation unit 54 to the catalytic dewaxing process as illustrated in FIG. 2.

In some instances it may be desirable to recycle some of the unconverted hydrocracker bottoms product 52 or unused fractions of this stream from the vacuum distillation unit 56, 58, 60, 62, 64 back to the hydrocracker 34. This is shown as stream 66. Alternatively, it may be desirable to send these unconverted hydrocracker bottoms streams to the hydrotreater as part of the hydrotreater feed 6, to a second hydrocracker, to a FCC unit, or to fuel. In another embodiment, the hydrocracker bottoms 38 may be catalytically dewaxed prior to vacuum distillation in unit 54. In this embodiment, catalytically dewaxed hydrocracker bottoms are sent to fractionator 42 and then to vacuum distillation unit 54. The lube fractions from distillation unit 54 are then sent to the hydrofinishing zone (unit 30 in FIG. 2).

Tables 5 and 6 (See Example 1, infra) illustrate how the lube product from a hydrocracker can be tailored by the addition of a lube vacuum distillation unit, as described in the instant invention.

II.C Hydrocracking Catalyst

The catalyst used in the present hydrocracking process may be a conventional hydrocracking catalyst which employs an acidic large pore size zeolite within the porous support material with an added metal hydrogenation/dehydrogenation function. Specific commercial hydrocracking catalysts, which may be used include UOP HC-22, and UOP HC-24. These are NiMo catalysts on a support of USY. ICR209, a Chevron catalyst which comprises Pd on a USY support, may also be employed. Table 4 lists suitable hydrocracking catalysts. The acidic functionality in the hydrocracking catalyst is provided either by a large pore, amorphous material such as alumina, silica-alumina or silica or by a large pore size crystalline material, preferably a large pore size aluminosilicate zeolite such as zeolite X, Y, ZSM-3, ZSM-18, ZSM-20 or zeolite beta. The zeolites may be used in various cationic and other forms, preferably forms of higher stability so as to resist degradation and consequent loss of acidic functionality under the influence of the hydrothermal conditions encountered during the hydrocracking. Thus, forms of enhanced stability such as the rare earth exchanged large pore zeolites, e.g. REX and REY are preferred, as well as the so-called ultra stable zeolite Y (USY) and high silica zeolites such as dealuminized Y or dealuminized mordenite.

Zeolite ZSM-3 is disclosed in U.S. Pat. No. 3,415,736, zeolite ZSM-18 in U.S. Pat. No. 3,950,496 and zeolite ZSM-20 in U.S. Pat. No. 3,972,983, to which reference is made for a description of these zeolites, their properties and preparations. Zeolite USY is disclosed in U.S. Pat. No. 3,293,192 and RE-USY is disclosed in U.S. Pat. No. 4,415,438. Hydrocracking catalysts comprising zeolite beta are described in EP94827 and U.S. Pat. No. 4,820,402, to which reference is made for a description of such catalysts.

The catalysts preferably include a binder such as silica, silica/alumina or alumina or other metal oxides e.g. magnesia, titania, and the ratio of binder to zeolite will typically vary from 10:90 to 90:10, more commonly from about 30:70 to about 70:30 (by weight).

TABLE 4

Catalysts Suitable for Use in Hydrocracking Step Prior to Dewaxing

| Vendor | Catalyst | Type |
|---|---|---|
| UOP | HC-24 | NiMo/USY |
| UOP | DHC-32 | NiW/USY |
| Chevron | ICR209 | Pd/USY |
| Acreon | HYC 632 | NiMo/Zeolite |
| Acreon | HYC 642 | NiMo/Zeolite |
| Acreon | HYC 652 | NiMo/Zeolite |
| Akzo | KC-2301 | NiMo/Zeolite |
| Akzo | KC-2601 | NiW/USY |
| Zeolyst | Z-703 | NiW/Zeolite |
| Zeolyst | Z-753 | NiW/Zeolite |
| Zeolyst | Z-623 | NiW/Zeolite |

II.D Hydrocracking Process Considerations

This hydrocracking process is carried out under conditions similar to those used for conventional hydrocracking. Process temperatures of about 260° to 480° C. (500° F. to 896° F.) may conveniently be used although temperatures above about 445° C. (833° F.) will normally not be employed since the thermodynamics of the hydrocracking reactions becomes unfavorable at temperatures above this point. Generally, temperatures of about 315° C. to 425° C. (5990 to 797° F.) will be employed. Total pressure is usually in the range of 1200 to 3000 psig (8375 to 20,786 kPa) and the higher pressures within this range over 1800 psig (12,512 kPa) will normally be preferred. The process is operated in the presence of hydrogen and hydrogen partial pressures will normally be at least 1200 psia (8274 kPa), preferably 1200–3000psia. The ratio of hydrogen to the hydrocarbon feedstock (hydrogen circulation rate) will normally be from 2000 to 10000 SCF/Bbl. (about 340 to 1700 Nm3/m3 ). The space velocity of the feedstock will normally be from 0.1 to 10 LHSV ($hr^{-1}$), preferably 0.5 to 5 LHSV. At low conversions, the n-paraffins in the feedstock will be isomerized to iso-paraffins but at higher conversion under more severe conditions the iso-paraffins will be converted to lighter materials.

The conversion may be carried out by contacting the feedstock with a fixed stationary bed of catalyst. A simple configuration is a trickle-bed operation in which the feed is allowed to trickle through a stationary fixed bed (FIG. 1 illustrates this). With such a configuration, it is desirable to initiate the reaction with fresh catalyst at a moderate temperature which is of course raised as the catalyst ages, in order to maintain catalytic activity. The hydrocracking catalyst may be regenerated by contact at elevated temperature with hydrogen gas, for example, or by burning in the presence of a mixture of air, nitrogen and flue gas.

II. Catalytic Dewaxing Process (or Hydrodewaxing or Hydroisomerization Process)

FIG. 2 illustrates a specific embodiment of the instant invention and is not intended to be limiting. A vertical reactor shell 10 encloses and supports a stacked series of fixed porous solid beds of dewaxing catalyst, as depicted by 12A through 12C. A chargestock 6 comprising wax-containing liquid oil is combined with a hydrogen-rich gas 8 and introduced to the reactor 10 after undergoing appropriate heating means 9. The combined chargestock and hydrogen-rich gas flow downwardly through the catalyst beds. Although 3 beds are depicted in this example, there may be more beds or as few as two. Liquid distribution is achieved by any conventional technique, such as distributor trays 13A, B, C, which project the liquid uniformly onto the catalyst bed surfaces 12A, B, C. Typically the gas and liquid phases are introduced into the reactor at a desired inlet pressure and temperature. The gas and liquid temperature may be adjusted between catalyst beds by the addition of hydrogen-rich quench gas 14A, B or alternatively by heat exchange of the liquid in an external flow loop, thereby allowing independent control of the temperature in any catalyst bed. A static mixer 15A, B or other suitable contacting device may be used to mix the liquid and gas streams between catalyst zones, including quench gas, to obtain a homogeneous temperature.

The hydrodewaxing reactor effluent 24 is heated or cooled, as necessary via heat exchange or furnace 25 and cascaded directly into the hydrofinishing reactor 30. A vertical reactor shell 30 encloses and supports a stacked series of fixed porous solid beds of hydrofinishing catalyst, as depicted by 32A through 32C. The liquid and gas flow downwardly through the catalyst beds. Although 3 beds are depicted in this example, there may be more beds or as few as two. Liquid distribution is achieved by any conventional technique, such as distributor trays 33A, B, C, which project the liquid uniformly onto the catalyst bed surfaces 32A, B, C. Typically the gas and liquid phases are introduced into the reactor at a desired inlet pressure and temperature. The gas and liquid temperature may be adjusted between catalyst beds by the addition of hydrogen-rich quench gas 34A, B or alternatively by heat exchange of the liquid in an external flow loop, thereby allowing independent control of the temperature in any catalyst bed. A static mixer 35A, B or other suitable contacting device may be used to mix the liquid and gas streams between catalyst zones, including quench gas, to obtain a homogeneous temperature.

The hydrofinisher effluent 36 passes through heat exchangers (not shown), separators 40 and fractionation equipment 42 to separate a recycle gas stream 44, converted fractions 46, and a finished lube base stock 48. A purge gas stream 50 would typically be withdrawn from the recycle gas to remove light hydrocarbon products. Gas scrubbing facilities (not shown) would typically be used to remove $NH_3$ and $H_2S$ from the recycle gas stream. Makeup hydrogen 52 is added to compensate for hydrogen consumed in the hydrodewaxing and hydrotreating reactions and purged in the gas and liquid product streams 50 and 46.

The continuous multi-stage reactor system has been described for contacting gas and liquid phases with a series of porous catalyst beds; however, it may be desired to have other reactor configurations with 2–5 beds. The catalyst composition may be the same in all beds of each reactor; however, it is within the inventive concept to have different catalysts and reaction conditions in the separated beds. Design and operation can be adapted to particular processing needs according to sound chemical engineering practices.

The present technique is adaptable to a variety of catalytic dewaxing operations, particularly for treatment of lubricant-range heavy oils with hydrogen-containing gas at elevated temperature. Industrial processes employing hydrogen, especially petroleum refining, employ recycled impure gas containing 10 to 30 mole % or more of impurities, usually light hydrocarbons and nitrogen. Such gases are available and useful herein, especially for high temperature hydrodewaxing at elevated pressure.

Advantageously, the catalyst bed has a void volume fraction greater than 0.25. Void fractions from 0.3 to 0.5 can be achieved using loosely packed polylobal or cylindrical extrudates, spheres or pellets providing adequate liquid flow rate component for uniformly wetting catalyst to enhance mass transfer and catalytic phenomena. Catalyst bed depths may range from 2 to 6 meters or more.

In the present process, a waxy lube feedstock, typically a 321° C.+ (about 610° F.+) feedstock is contacted with an intermediate pore size molecular sieve catalyst having dewaxing and/or isomerization or hydroisomerization functions in the presence of hydrogen to produce a dewaxed lube boiling range product of low pour point (ASTM D-97 or equivalent method such as Autopour). For typical waxy feedstock the hydrogen feedrate at the top of the dewaxing reactor is about 267–534 $Nm^3/m^3$ (1500–3000 SCF/BBL). In order to improve the stability of the dewaxed lube boiling range materials in the dewaxed effluent, a hydrofinishing step is generally carried out.

Hydrodewaxing Process Considerations

In general terms, when ZSM-5 is the active component in the catalyst, the catalytic dewaxing process step is operated under conditions of elevated temperature, usually ranging from about 205° to 400° C. (401° to 752° F.), preferably from 235° to 385° C. (455° to 725° F.), depending on the dewaxing severity necessary to achieve the target pour point for the product. When other less active catalysts are used, the temperature may be 25 to 50° C. higher than for ZSM-5.

As the target pour point for a product is decreased, the severity of the dewaxing process is increased by raising the reactor temperature so as to effect an increasingly greater conversion of normal paraffins, so that lube yield will generally decrease with decreasing product pour point as successively greater amounts of the normal paraffins (wax) in the feed are converted by selective cracking by the dewaxing catalyst to lighter products boiling outside the lube boiling range. The V.I. of the product will also decrease as pour point is lowered because the high V.I. normal paraffins and slightly branded isoparaffins are progressively converted.

In addition, the dewaxing temperature is increased throughout the dewaxing cycle to compensate for decreasing catalyst activity due to catalyst aging. The dewaxing cycle will normally be terminated when a temperature of about 400° C. (about 750° F.), but preferably about 385° C. (725° F.) is reached since viscosity and product stability are adversely affected at higher temperatures. When ZSM 5 is the active catalytic ingredient with less active catalysts, these temperatures may be 25 to 50° C. higher.

Hydrogen promotes extended catalyst life by a reduction in the rate of coke laydown on the dewaxing catalyst. ("Coke" is a highly carbonaceous hydrocarbon which tends to accumulate on the catalyst during the dewaxing process.) The process is therefore carried out in the presence of hydrogen, typically at about 2758 to 20,685 kPa hydrogen partial pressure (400 to 3000 psia), preferably between 9653 to 17238 kPa (1400 to 2500 psi) more preferably between 1600 to 2200 psi (11032 to 15169 kPa) although higher pressures can be employed. Hydrogen circulation rate is typically 1000 to 8000 SCF/bbl, usually 2000 to 3000 SCF/bbl of liquid feed (about 180 to 710, usually about 355 to 535 $Nm^3/m^3$) at the reactor inlet additional $H_2$ may be added at the quench points. Space velocity will vary according to the chargestock and the severity needed to achieve the target pour point, but is typically in the range of 0.25 to 5 LHSV ($hr^{-1}$), preferably 0.5 to 3 LHSV for all catalysts.

Hydrodewaxing Catalysts

Recent developments in zeolite technology have provided a group of constrained medium pore siliceous materials having similar pore geometry. The preferred hydrodewaxing catalyst comprises a porous acid molecular sieve having pores comprised of 10 oxygen atoms alternating with predominantly silicon atoms, such as aluminosilicate zeolite. Most prominent among these intermediate pore size zeolites are ZSM-5, ZSM-23, ZSM-35, ZSM-48 and ZSM-57 which are usually synthesized with Bronsted acid active sites by incorporating a tetrahedrally coordinated metal, such as Al, Ga, or Fe, within the zeolitic framework. Medium pore molecular sieves having pore dimensions about 3.9 to 6.3 Angstroms are favored for shape selective acid catalysis; however, the advantages of medium pore structures may be utilized by employing highly siliceous materials or crystalline molecular sieve having one or more tetrahedral species having varying degrees of acidity. These shape selective materials have at least one channel with pores formed by ten-member rings containing ten oxygen atoms alternating with silicon and/or metal atoms.

The catalysts which have been proposed for shape selective catalytic dewaxing processes have usually comprised molecular sieves which have a pore size which admits the straight chain, waxy n-paraffins either alone or with only slightly branched chain paraffins but which exclude more highly branched materials and cycloaliphatics. Representative of the medium pore molecular sieves are ZSM-5 (U.S. Pat. No. 3,702,886), ZSM-11 (U.S. Pat. No. 3,709,979), ZSM-22, ZSM-23 (U.S. Pat. No. 4,076,842), ZSM-35 (U.S. Pat. No. 4,016,245), ZSM-48 (U.S. Pat. No. 4,375,573), ZSM-57, MCM-22 (U.S. Pat. No. 4,954,325), SAPO-11 (U.S. Pat. No. 4,859,311), SAPO-41 and isostructural molecular sieves. (See FIG. 4). The disclosures of these patents are herein incorporated by reference.

Molecular sieves offer advantages in catalytic dewaxing over noncrystalline catalysts. Molecular sieves are broadly classed into small, medium (or intermediate), and large pore materials as shown in FIG. 4. The pore size is fixed by a ring of oxygen atoms. Small pore zeolites have eight-membered ring openings, medium have ten-membered systems and large have twelve-membered systems. Catalytic dewaxing performance can also be affected by the catalyst's pore structure, whether it has uni- or bidimensional channels, and the nature of its channel intersections. Severely constrained, small pore zeolites are ineffective in lube oil dewaxing because they allow only small, normal paraffins to penetrate the pore channel. In comparison, large pore zeolites permit non-selective cracking of some desirable lube components resulting in lower yields than those from medium pore zeolites.

HZSM-5 is one of a number of medium pore size zeolites which are capable of shape-selective dewaxing. Other examples include ZSM-11, ZSM-22, ZSM-23, ZSM-35, ZSM-48 and ZSM-57. The pore structure of ZSM-5 provides a balance of reactant shape selectivity, reduced coking tendency and exclusion of bulky nitrogen-containing catalyst poisons. HZSM-5, Pt/ZSM-23, Pd/ZSM23, Pt/ZSM-48, Pt/SAPO-11 and Pt/SAPO-41 with appropriately adjusted physicochemical properties are preferred in the instant invention because their channel systems and pore dimensions enable effective de-waxing of fuels hydrocracker bottoms.

Suitable molecular sieves having a coordinated metal oxide to silica molar ratio of 20:1 to 200:1, or higher may be used. With HZSM-5, for example, it is advantageous to employ conventional aluminosilicate ZSM-5 having a silica:alumina molar ratio of about 25:1 to 70:1 although ratios above 70:1 may be used. A typical zeolite catalyst component having Bronsted acid sites may consist essentially of crystalline aluminosilicate having the structure of ZSM-5 zeolite with 5 to 95 wt. % silica, clay and/or alumina binder. It is understood that other medium pore acidic molecular sieves, such as silica-aluminophosphate (SAPO) materials may be employed as catalysts, especially medium pore SAPO-11. U.S. Pat. No. 4,908,120 (Bowes et al) discloses a catalytic process useful for feeds with high paraffin content or high nitrogen levels. The process employs a binder free zeolite dewaxing catalyst, preferably ZSM-5.

Medium pore zeolites are particularly useful in the process because of their regenerability, long life and stability under the extreme conditions of operation. Usually the zeolite crystals have a crystal size from about 0.01 to 2 microns or more, with 0.02–1 micron being preferred. Although ZSM-5 (≧40 alpha) can be used in its metal-free form for selective cracking, in the case of the other medium pore acidic metallo-silicates described supra, it is preferred that they be modified with from 0.1 to 1.0 wt. % of noble metal in order to be used as hydroisomerization dewaxing catalysts.

ZSM-5 is the only medium pore zeolite or medium pore acidic molecular sieves that is practical to use for commercial selective dewaxing without adding a noble metal. The noble metal is preferred for use with other medium pore molecular sieves in order to reduce catalyst aging rates to practical levels. The addition of a noble metal to ZSM-5, however, provides it with hydroisomerization activity that increases yields of dewaxed lube oils. It has been found that when noble metals are added to ZSM-23, ZSM-35, SAPO-11 and ZSM-5, the product yields and VI are generally higher for ZSM-23, ZSM-35 and SAPO-11 than for ZSM-5. Catalyst size can vary widely within the inventive concept, depending upon process conditions and reactor structure. Finished catalysts having an average maximum dimension of 1 to 5 mm are preferred.

Catalytic Dewaxing Conditions

In most of the catalytic dewaxing examples herein the catalyst employed is 65 wt. % ZSM-5 having an acid cracking (alpha) value of 105, and formed as 1.6 mm diameter extrudate; however, alpha values from about 1 to about 300 may be used. Reactor configuration is an important consideration in the design of a continuously operating system. In its simplest form, a vertical pressure vessel is provided with a series (at least 2) of stacked catalyst beds of uniform cross-section. A typical vertical reactor having a total catalyst bed length to average width (L/D aspect) ratio of about 1:1 to 20:1 is preferred. Stacked series of beds may be retained within the same reactor shell; however, similar results can be achieved using separate side-by-side reactor vessels. Reactors of uniform horizontal cross section are preferred; however, non-uniform configurations may also be employed, with appropriate adjustments in the bed flux rate and corresponding recycle rates.

The invention is particularly useful in catalytic hydrodewaxing of heavy petroleum gas oil lubricant feedstock boiling above 260° C. (500° F.). The catalytic dewaxing treatment may be performed at a liquid hourly liquid space velocity not greater than 5 $hr^{-1}$, preferably about 0.5–3 $hr^{-1}$, over randomly packed beds of extrudate catalyst of the medium pore type molecular sieve catalyst. The hydrocarbon feedstock to the catalytic dewaxer has a viscosity of 3 to 12 cSt at 100° C. Advantageously, the liquid flux rate for total feed rate (including optional liquid recycle) is maintained in the range of 500–3500 pounds/$ft^2$-hr, preferably 1000–3000 pounds/$ft^2$-hr.).

IV. Hydrofinishing Following Catalytic Dewaxing

In order to improve the quality of the dewaxed lube products, a hydrofinishing step (see FIG. 2) follows catalytic dewaxing in order to saturate lube range olefins as well as to remove heteroatoms, color bodies and, if the hydrofinishing pressure is high enough, to effect saturation of residual aromatics. The post dewaxing hydrofinishing is usually carried out in cascade with the dewaxing step. Generally, at start-of-cycle, the hydrofinishing will be carried out at temperatures from about 170° C. to 350° C., preferably 200° C. to 343° C. and most preferably 220° C. to 300° C. Total pressures are typically from 2859 to 20786 kPa (about 400 to 3000 psig). Liquid hourly space velocity in the hydrotreater is typically from 0.1 to 5 LHSV ($hr^{-1}$), preferably 0. 5 to 3 $hr^{-1}$.

Processes employing sequential lube catalytic dewaxing hydrofinishing are described in U.S. Pat. Nos. 4,181,598, 4,137,148 and 3,894,938. A process employing a reactor with alternating dewaxing-hydrofinishing beds is disclosed in U.S. Pat. No. 4,597,854. Reference is made to these patents for details of such processes. The hydrofinishing step following the dewaxing step improves product quality without significantly affecting its pour point. The metal function on the hydrofinishing catalyst is effective in saturating aromatic components. Thus, a hydrofinishing (HDF) catalyst with a strong hydrogenation function that a noble metal, nickel tungsten or nickel-molybdenum can provide, will be more effective than a catalyst comprising a weaker metal function such as molybdenum alone. The preferred hydrofinishing catalysts for aromatics saturation will comprise at least one metal having relatively strong hydrogenation function on a porous support. Because the desired hydrogenation reactions require little acidic functionality and because no conversion to lower boiling products is desired in this step, the support of the hydrofinishing catalyst is of low acidity. Typical support materials include amorphous or crystalline oxide materials such as alumina, silica, and silica—alumina of low-acidic character. The metal content of the catalyst is often as high as about 20 weight percent for non-noble metals. Noble metals are usually present in amounts no greater than 1.2 wt. %. Hydrofinishing catalysts of this type are readily available from catalyst suppliers. The nickel-tungsten catalysts may be fluorided. Catalyst may also include bulk metal catalysts described above as hydrotreating catalyst.

Control of the reaction parameters of the hydrofinishing step offers a useful way of varying the stability of the products. Using a combination of Periodic Group VIIIA and VIA (IUPAC Periodic Table) metals, such as Ni/W, hydrofinishing catalyst temperatures of about 230–300° C. (446°–572° F.) will minimize single-ring aromatics and polynuclear aromatics. They will also provide products having good oxidative stability, UV light stability, and thermal stability. Space velocity in the hydrofinisher also offers a potential for aromatics saturation control with the lower velocities effecting greater aromatics saturation. The hydrofinished product preferably contains not more than 10 wt. % aromatics.

EXAMPLES

The following examples are intended to be descriptive only and are in no way to be considered as limiting:

Example 1

Table 5 provides an analysis of an atmospheric tower bottoms product from a commercial two stage hydrocracker. Such a hydrocracker possesses a hydrotreater reactor and a hydrocracking reactor, but does not employ the vacuum distillation unit as described in the hydrocracking unit of the instant invention. The product is roughly a 330–538° C. (625–1000° F.) cut and is very low in heteroatom and aromatic content, particularly nitrogen. The hydrocracking catalyst employed was fresh. A full range analysis of the drum of the atmospheric tower bottoms as received is reported in the "total bottoms" column. The bottoms were broken down into five equal volume cuts and analyzed for key properties. These analyses are also provided in Table 5.

After the hydrodewaxing process, which includes catalytic dewaxing, hydrofinishing, and distillation, the final product must possess the following characteristics:

Viscosity Index≧115

NOACK>6≦20

Viscosity (4-ScSt at 100° C.)

Color (Saybolt)≧20

Pour Point≦25° F.(−4° C.)

Aromatics≦5 wt. %

Color stable in sunlight

In order to obtain a final product with these characteristics, it is desirable to begin with a chargestock with as high a VI and as low a NOACK (or as high a flash point) as possible. The hydrodewaxing procedure lowers pour point. In Table 5, the more volatile fractions had lower pour points and the heavier, less volatile fractions had higher VI. The most volatile fraction, distilled at 0–20% had a low viscosity (2.77 centistokes at 100° C.) and a VI below 115 and is therefore unsuitable for use.

It is desirable to obtain chargestock with characteristics in an acceptable range in order to attain the above product properties. In the instant invention, a vacuum distillation step is employed. As Table 6 illustrates, even the lightest, most volatile fraction of the hydrocracked and vacuum distilled bottoms product is suitable for use, having a VI greater than 115 and a viscosity greater than 4 centistokes at 100° C.

TABLE 5

| | Commercial Hydrocracker Atmospheric Bottoms Distillation into 5 Equal-Volume Cuts | | | | | |
|---|---|---|---|---|---|---|
| | Total Bottoms | 0–20% | 20–40% | 40–60% | 60–80% | 80–100% |
| Yields on Dist. | | | | | | |
| wt. % | | 19.4 | 19.0 | 18.7 | 19.9 | 23.1 |
| vol. % | | 19.5 | 19.1 | 18.6 | 19.8 | 22.9 |
| Gravity, °API | 38.4 | 39.4 | 39.5 | 37.7 | 37.8 | 37.2 |
| SP. Gr. 60° F./60° F. | 0.8329 | 0.8280 | 0.8275 | 0.8363 | 0.8358 | 0.8388 |
| Pour Point, 'F | 100 | 60 | 75 | 90 | 100 | 120 |
| ASTM Color | <0.5 | | | | | |
| COC Flash Point, ° F. | 421 | | | | | |
| KV @ 40° C., cSt | 19.33 | 10.23 | 13.72 | 17.34 | — | — |
| KV @ 100° C., cSt | 4.370 | 2.770 | 3.456 | 4.144 | 4.972 | 7.365 |
| KV @ 300° C., cSt | 2.285 | 1.521 | 1.824 | 2.062 | 2.460 | 3.278 |
| SUS @ 100° F. | 101 | 62 | 76 | 92 | 113 | 216 |
| VI | 141 | 114 | 132 | 147 | — | |

TABLE 6

| | Vacuum Distillation Bottoms of Fuels Hydrocrackate Distillation into 5 Equal-Volume Cuts | | | | | |
|---|---|---|---|---|---|---|
| | Vacuum Distillation Bottoms | 0–20% | 20–40% | 40–60% | 60–80% | 80–100% |
| Yields on Dist. | | | | | | |
| wt. % | | 19.1 | 18.7 | 18.7 | 18.9 | 24.5 |
| Vol. % | | 19.2 | 18.7 | 18.7 | 18.7 | 24.1 |
| Gravity, °API | 35.6 | 35.9 | 35.5 | 34.9 | 34.1 | 32.9 |
| Sp. Gr. 60° F./60° F. | 0.8468 | 0.8453 | 0.8473 | 0.8504 | 0.8545 | 0.8607 |
| Pour Point, ° F. | 110 | 80 | 85 | 85 | 85 | 100 |
| ASTM Color | 3.5 | | | | | |
| COC Flash Point, ° F. | 500 | | | | | |
| KV @ 40° C., cSt | — | 23.76 | — | — | — | — |

TABLE 6-continued

| | Vacuum Distillation Bottoms of Fuels Hydrocrackate Distillation into 5 Equal-Volume Cuts | | | | | |
|---|---|---|---|---|---|---|
| | Vacuum Distillation Bottoms | 0–20% | 20–40% | 40–60% | 60–80% | 80–100% |
| KV @ 100° C., cSt | 7.115 | 4.898 | 5.505 | 6.354 | 7.480 | 10.42 |
| KV @ 300° C., cSt | 3.308 | 2.373 | 2.626 | 2.933 | 3.359 | 4.308 |
| SUS @ 100° F. | 182 | 123 | 137 | 170 | 212 | 364 |
| VI | — | 133 | — | — | — | — |

Example 2

Figure 5:
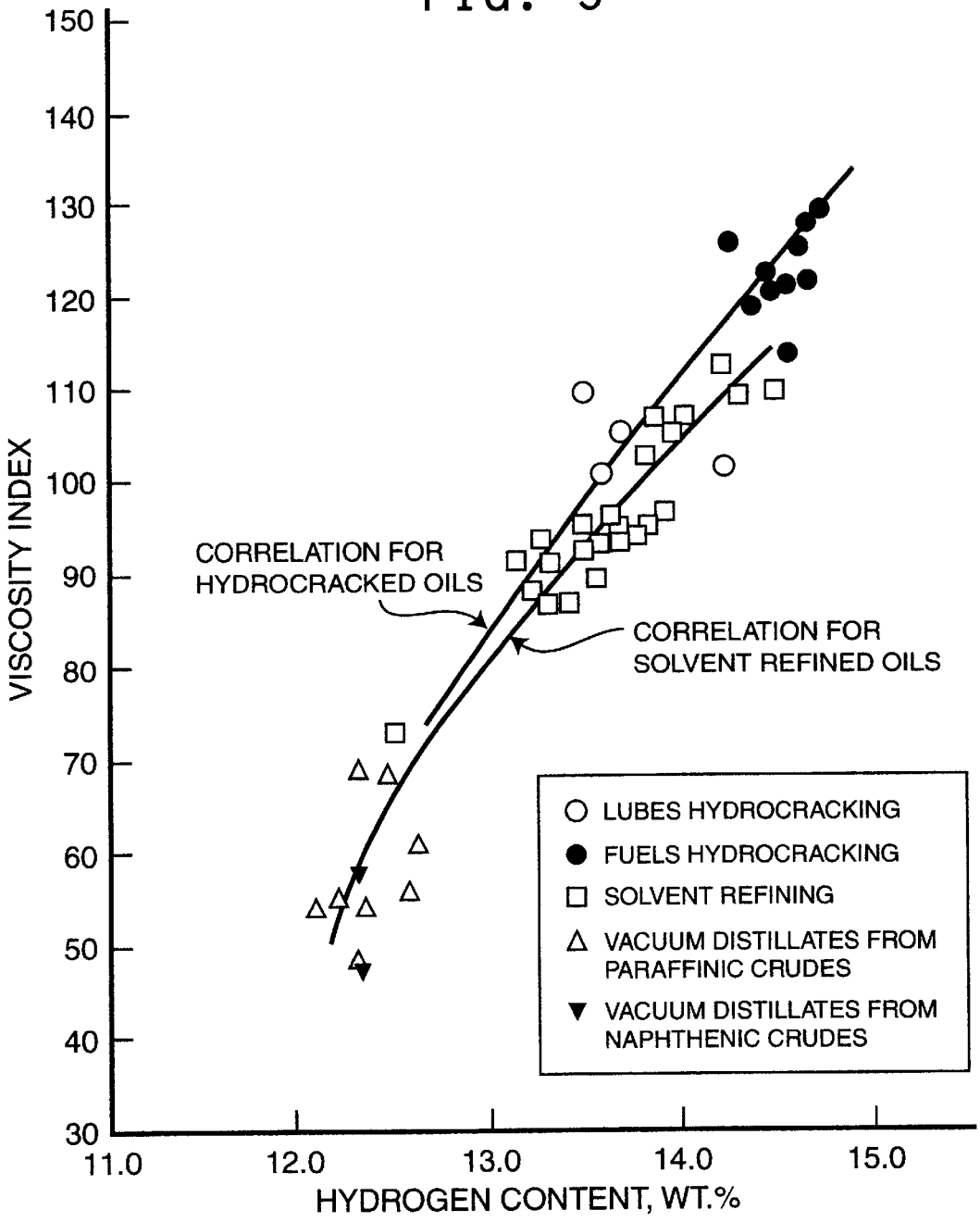

FIG. 5 illustrates the relationship of Viscosity Index v. Hydrogen content for lube oils having a pour point of −7° C. wherein the oils have been refined either by solvent refining or by hydrocracking. Each of the various waxy stocks compared was solvent dewaxed to a −7° C. pour point. As the weight percent hydrogen present in a lubricant base stock increases, the VI, viscosity index, improves. The VI improves somewhat more for hydrocracked stocks than for solvent refined stocks. The empty circles represent lubestocks obtained by lubes hydrocracking, distillation, and solvent dewaxing without further treatment. Circles containing crossed lines represent lubestocks refined by fuels hydrocracking, distillation, and solvent dewaxing. Squares represent lubestocks that were solvent refined and solvent dewaxed. Upright triangles represent vacuum distillates obtained from paraffinic crudes. Inverted triangles represent vacuum distillates obtained from naphthenic crudes.

It is apparent that fuels hydrocracking of a given vacuum gas oil will provide lubestocks of higher VI than lubes hydrocracking or solvent refining because fuels hydrocracking is more severe than lubes hydrocracking. In the instant invention, dewaxed lubestocks have a VI of at least 105, preferably at least about 115. From FIG. 5, the dewaxed oil product has a hydrogen content of at least about 14.1 wt. % in order to obtain a VI of 115 and a hydrogen content of at least about 13.7 wt. % for a VI of 105. Because dewaxing lowers hydrogen content the waxy oil is about 0.2 to 0.5 wt. % higher in hydrogen content than the dewaxed oil for a ZSM-5 catalyst. PONA analysis of these hydrocracked lubestocks on FIG. 5 demonstrated that they possess wide variations in composition, some having a high paraffinic content and others having a high naphthenic content, others being in between. An infinite variety of compositions is therefore possible at any VI level and the variation can be described by a range of hydrogen contents for any VI level. The hydrogen content of 150 isoparaffins ranges from 15.1% to 14.6% for carbon numbers ranging from $C_{17}$ to $C_{55}$, respectively. For alkylcyclohexanes, it is constant at 14.37% and for alkylbenzenes the range is 12.4 to 13.69%. From this it follows that the dewaxed oil product must be rich in high hydrogen content, isoparaffins and alkylcyclohexanes. A fuels hydrocracker, that is, a hydrocracker that operates in excess of 30% conversion to 345° C. minus light products, can produce a 345° C. plus product having the appropriate hydrogen content to provide a dewaxed oil having a viscosity index of 105.

Example 3

Figure 6A:
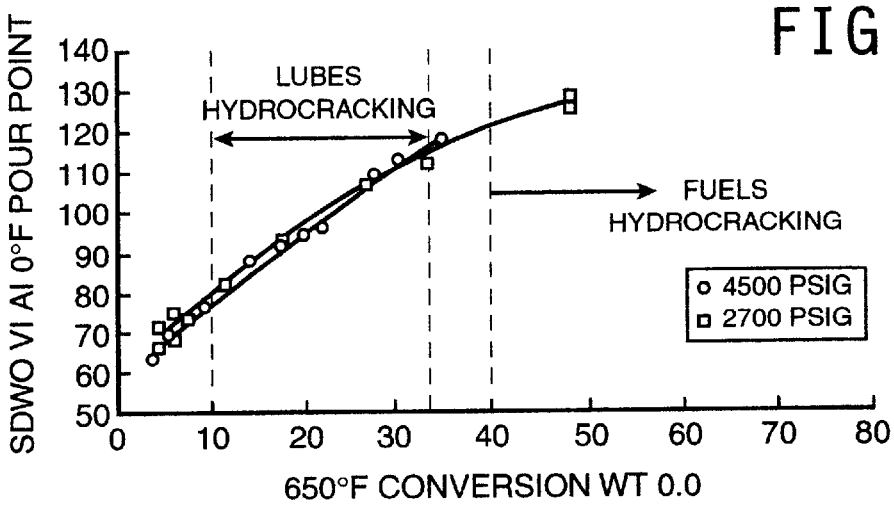
Figure 6B:
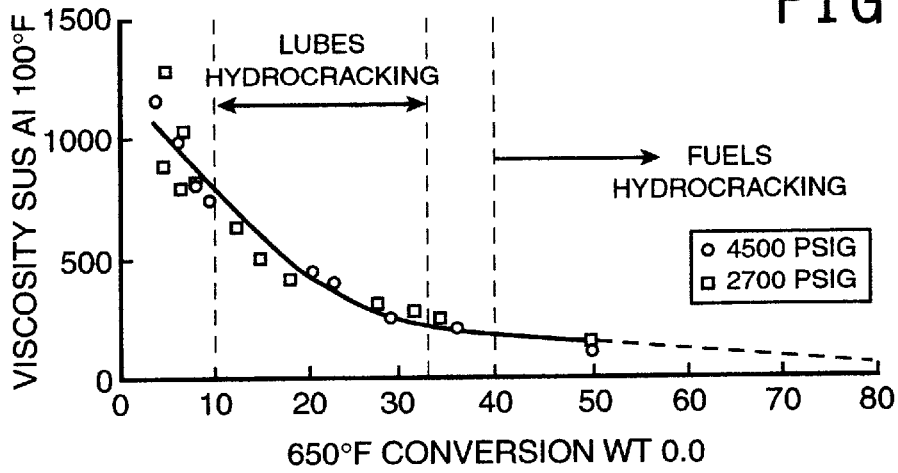
Figure 6C:
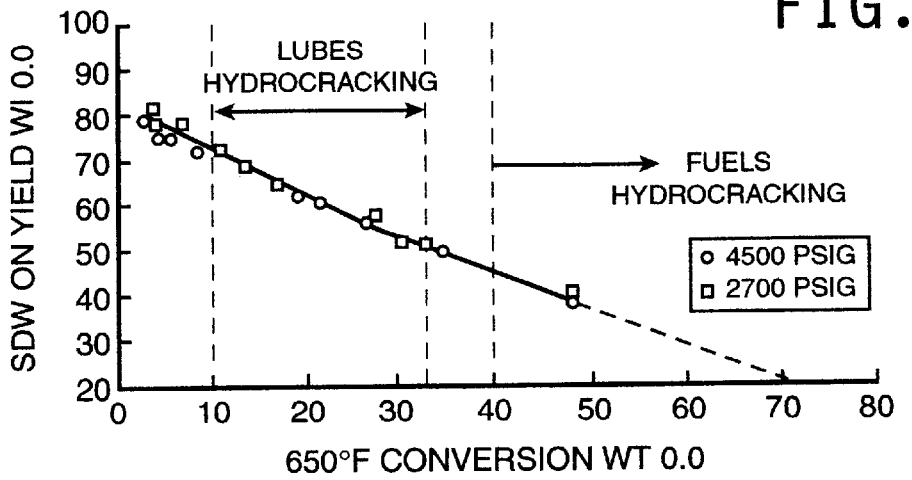

FIG. 6 (parts a, b, and c) is a demonstration of lubes hydrocracking and fuels hydrocracking for a heavy vacuum gas oil derived from Statfjord crude oil. The heavy vacuum gas oil was hydrocracked in a pilot plant at various conversions and the hydrocrackate was distilled to remove all of the 345° C.− (653° F.−) materials. The waxy 345° C. plus oils were then solvent dewaxed to −18° C. (0° F.) pour point and the viscosities and VI's were determined. The conversion range from 10 to about 30% is referred to as the lubes hydrocracking range and the conversion level from 30% and higher is referred to as the fuels hydrocracking range. It is obvious that to attain a dewaxed product having a VI of 115 hydrocracking conversion of about 35% is required. The degree of conversion required is dependent upon the viscosity index of the feed to the hydrocracker. FIG. 6 also demonstrates how viscosity is reduced as hydrocracking proceeds. FIG. 6 also shows that 345° C.+ yields are low in fuels hydrocrackers.

The data in Examples 4 to 12 was obtained from a two reactor process for catalytic dewaxing and hydrotreating. (See Example 5 for detailed discussion.) The first reactor contained a proprietary hydrodewaxing catalyst, HZSM-5.

The same hydrodewaxing catalyst was used for both high and low pressure operation. In the second reactor a commercial hydrofinishing catalyst was employed. In low pressure (400–600 psig) operation, the hydrofinishing catalyst is designed only for olefin saturation. Some level of aromatics saturation is necessary for good oxidative and UV light stability, however. In a high-pressure (2500 psig) operation, the hydrofinishing catalyst is designed for aromatics saturation. The hydrofinishing catalyst employed at low pressure was also evaluated at 2200 psig in order to provide a comparison.

Example 4

The NOACK volatility test (see FIGS. 7 and 8) which was conducted on the neat (unadditized) base stocks, follows CEC L-40-T-87 "Evaporation Loss of Lubricating oils" using the NOACK Evaporative Tester. In summary, the method measures the wt. % evaporative loss of a sample held at 250° C. (482° F.) under a constant stream of air for a period of 60 minutes.

Figure 7:
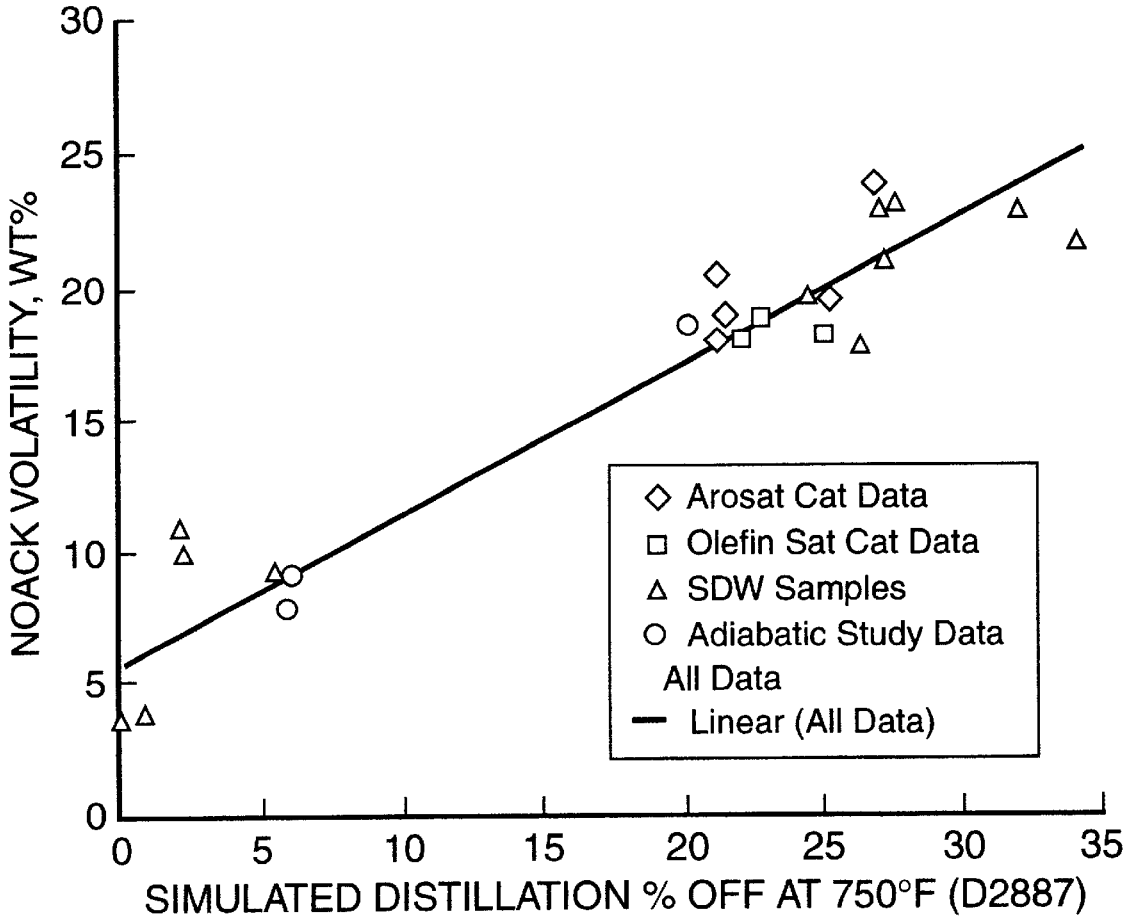
Figure 8:
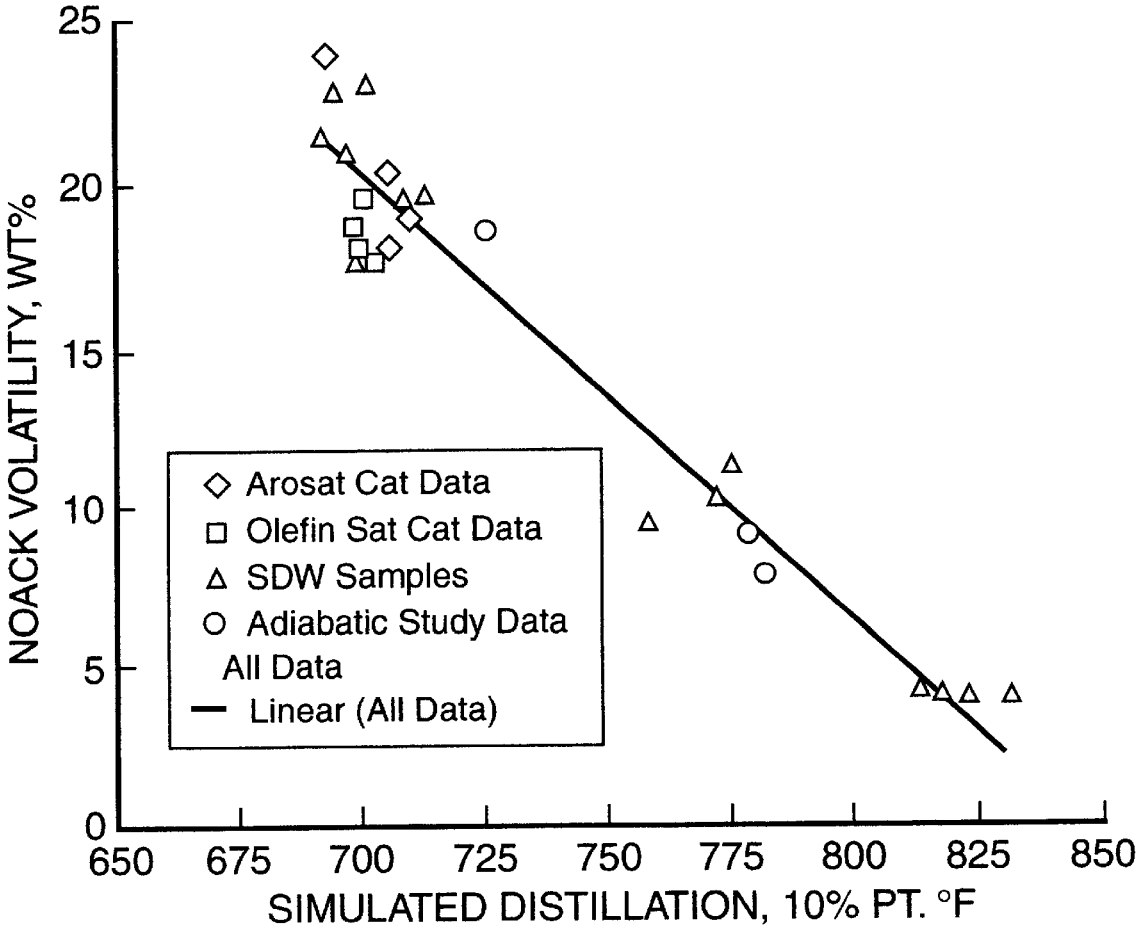

NOACK volatilities of the base stocks produced by high and low pressure catalytic dewaxing followed by hydrofinishing are shown on FIG. 7. In general, NOACK volatility can be correlated with the percent off at 750° F. in D2887 simulated distillation (see FIG. 7 and Table 7). For these products there is also good correlation between NOACK volatility and the 10% point. (see FIG. 8).

Figure 9:
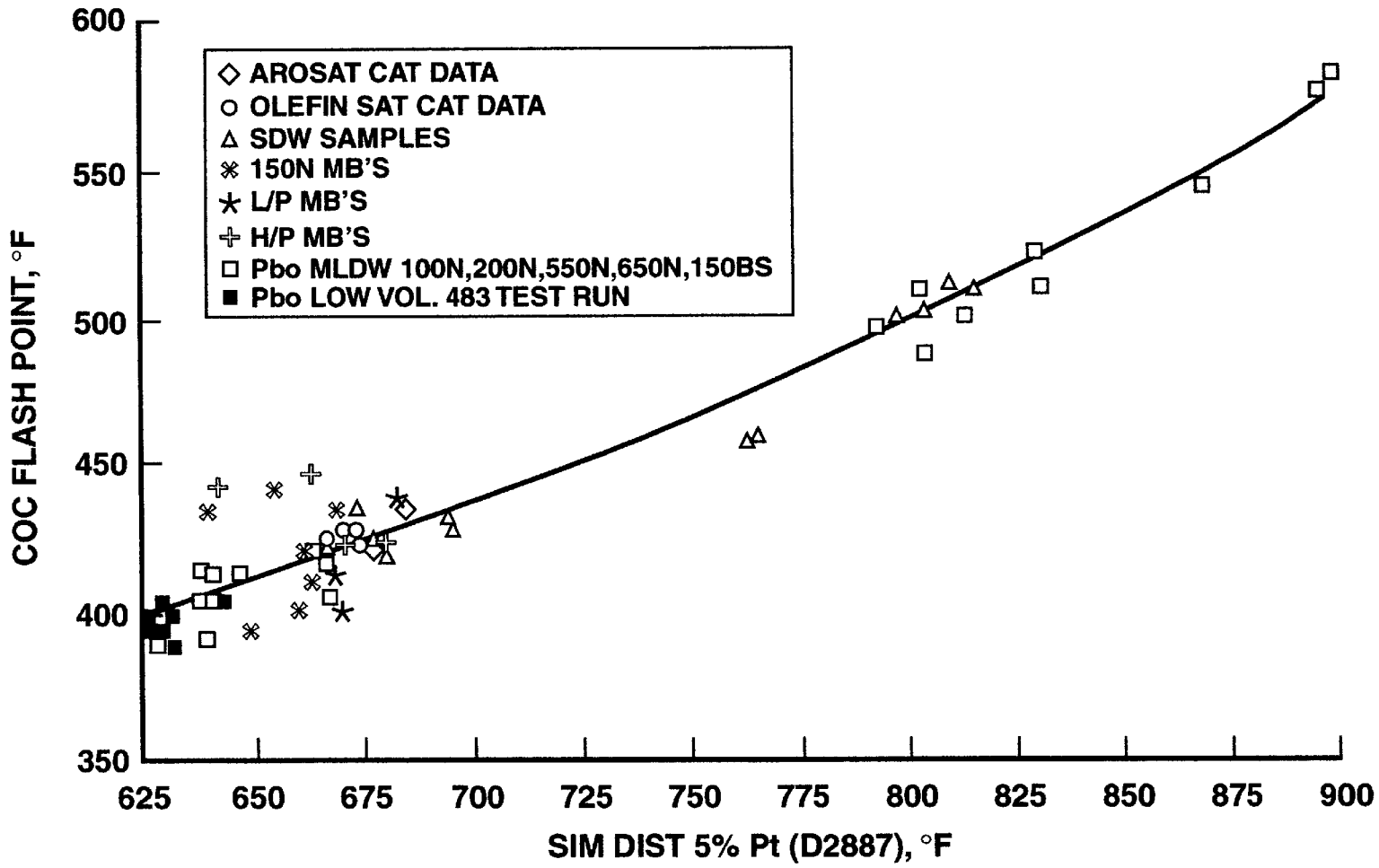

Flash point and Noack volatility behave in an opposite fashion when related to 5% or 10% boiling points respectively. FIG. 9 provides a correlation of flash point and 5% boiling point.

TABLE 7

Comparison of Products obtained Employing High Pressure HDF v. Standard HDF

| Type HDF Cat | Aromatics Saturation Catalyst | | | | Standard Olefin Saturation Catalyst | | | |
|---|---|---|---|---|---|---|---|---|
| Conditions | | | | | | | | |
| Pressure, psig (100% $H_2$) | 2500 | 2500 | 2500 | 2500 | 400 | 400 | 400 | 2200 |
| HDF Temp, ° F. | 625 | 575 | 525 | 450 | 465 | 500 | 550 | 500 |
| Neat (Unadditized) Oil | | | | | | | | |
| NOACK Volatility, wt. % | 23.8 | 18.8 | 17.9 | 20.3 | 18.6 | 17.7 | 19.5 | 18.0 |
| SAB Color | 28 | 28 | 29 | 29 | 1.0 | 1.5 | −16 | 9 |
| Light Stability, Days to Haze/Ppt | 42+ | 42+ | 42+ | 42+ | <4 | <4 | <4 | <4 |
| Sim Dist, % off at 750° F. | 26.3 | 21.0 | 20.8 | 20.7 | 22.3 | 21.6 | 24.6 | 24.6 |
| UV Absorptivity, L/g-cm | | | | | | | | |
| 226 nm | 0.0113 | 0.00415 | 0.00255 | 0.0281 | 0.923 | 0.766 | 0.726 | 0.324 |
| 254 nm | 0.000740 | 0.000379 | 0.000219 | 0.00119 | 0.133 | 0.122 | 0.129 | 0.0223 |
| 275 nm | 0.00120 | 0.000461 | 0.000283 | 0.00250 | 0.161 | 0.142 | 0.158 | 0.0372 |
| 325 nm | 0.000460 | 0.000063 | <0.000100 | <0.000100 | 0.0287 | 0.0341 | 0.0467 | 0.00336 |
| 400 nm | 0.000006 | 0.000003 | <0.000100 | <0.000100 | 0.00275 | 0.00386 | 0.00513 | <0.000100 |
| Oil + 0.3% Irganox ML 820 | | | | | | | | |
| RBOT Oxidation Test Minutes to 25 psi drop | 580 | 500 | 565 | 565 | 472 | 510 | 640 | 560 |

Example 5

Both catalyst systems (high pressure catalytic dewaxing+Arosat HDF catalyst (fluorided $NiW/Al_2O_3$) and low pressure catalytic dewaxing+HDF catalyst ($Mo/Al_2O_3$) easily met specification pour point and produced similar lube yields and viscosities with hydrocracked low aromatic, low nitrogen feedstock. General characteristics are summarized below.

Operation at 2500 psig (vs. 400 psig) reduces dewaxing catalyst aging from 2.3 to 0.2° F./day, greatly extending potential cycle length and improving unit stream factor. Pour point reduction is twice as responsive to catalytic dewaxing temperature changes at the high pressure, which could facilitate production of very low pour point base stocks, if desired. (See FIG. 10)

Figure 12:
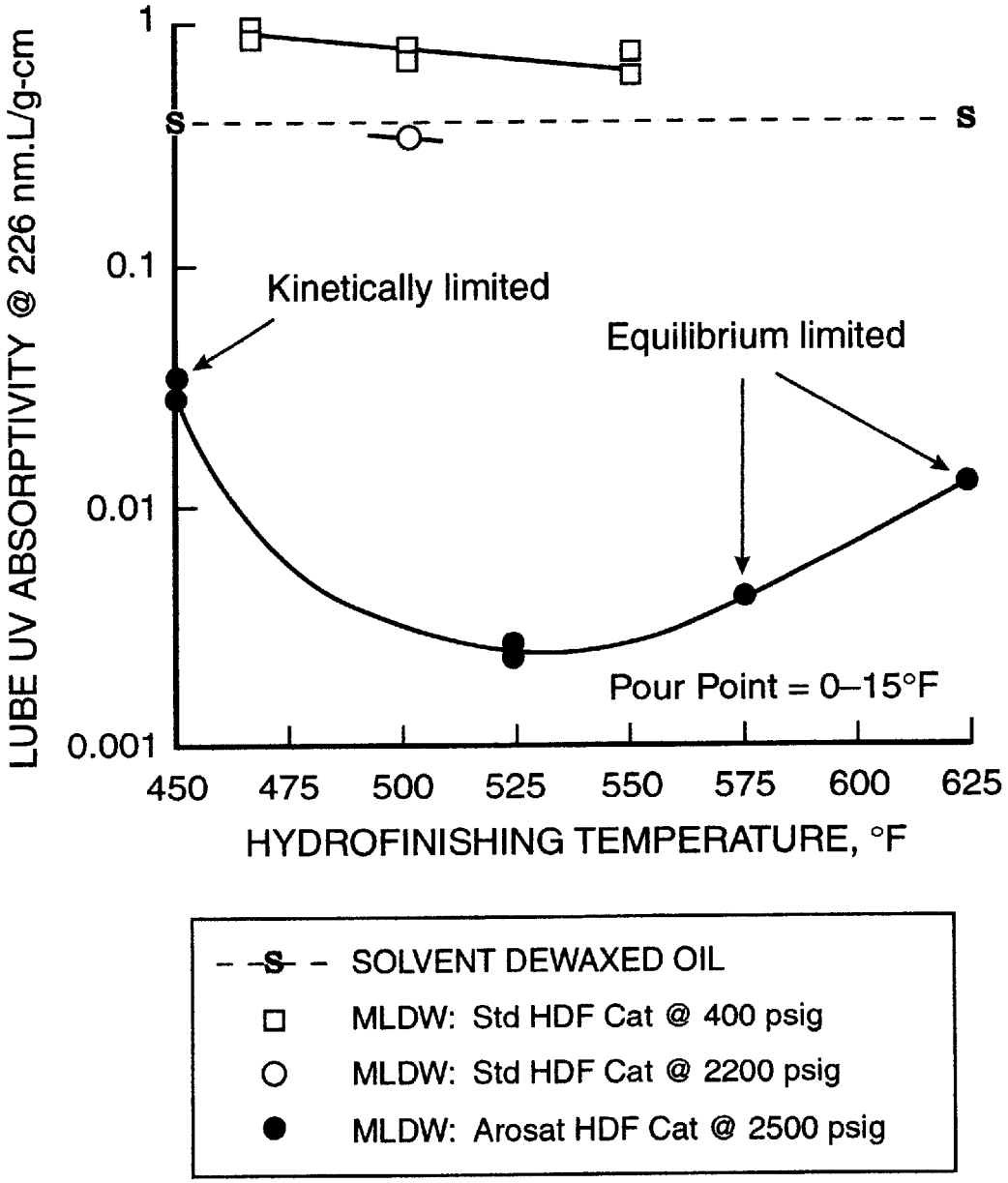

Lube yields and VI's are relatively insensitive to pressure (see FIG. 11), producing 67–72 wt. % yield of 121 VI, 116 SUS base stock at 5° F. pour point (versus 82 wt. %, 129 VI, 107 SUS with solvent dewaxing on a dry wax basis). Standard low pressure catalytic dewaxing allowed little adjustment in total aromatics levels as determined by UV absorptivity at 226 nm (FIG. 12). Use of an aromatics saturation catalyst at 2500 psig allowed reduction of aromatics to equilibrium levels at 525° F. HDF temperature, as determined by UV absorptivities.

The low pressure program was run in a two-reactor pilot plant with online $N_2$ stripping capability. Reactor 1 was loaded with 225 cc of dewaxing catalyst containing HZSM-5. Reactor 2 was loaded with 225 cc of hydrofinishing catalyst ($Mo/Al_2O_3$), which is designed for olefin saturation and low desulfurization (critical for maintaining oxidation stability of conventionally-refined lube base stocks). Both catalysts were 1/16" cylindrical extrudates and were commercially produced.

The low pressure work was done at 400 psig total pressure using pure $H_2$ (415 psi $H_2$ partial pressure) and 1 LHSV (each reactor), with 2500 scf/B $H_2$ circulation. Three HDF temperatures (465° F., 525° F., and 550° F.) were investigated at specification pour point (5° F.) to bracket an optimum treating severity for producing UV light-stable base stock. High pressure catalytic dewaxing was performed in a two reactor pilot plant. Reactor 1 was loaded with 262 cc of dewaxing catalyst. This catalyst was the same dewaxing catalyst used in the standard pressure run. Reactor 2 was loaded with 62 cc of a commercial hydrofinishing catalyst with excellent aromatics saturation capabilities (Arosat). It is commercially available as a 1/16" quadrulobe extrudate.

The high pressure catalytic dewaxing was done at 2500 psig total pressure using pure $H_2$ (2515 psi $H_2$ partial pressure) and 1 LHSV (each reactor), with 2500 scf/B $H_2$ circulation. Four hydrofinishing temperatures (625° F., 575° F., 525° F. and 450° F.) were investigated at specification pour point (5° F.) to bracket an optimum treating severity for producing UV light-stable base stock. The data of FIG. 12 clearly demonstrate that good aromatic saturation catalysts are needed in the hydrofinisher following the dewaxing reactor.

Example 6

Sunlight Stability

Description of Method

In this test, the neat (unadditized) base stock is exposed to natural sunlight in a glass bottle and observed periodically for haze, precipitate, and color change. All samples were run simultaneously at the same location.

Results

Figure 13:
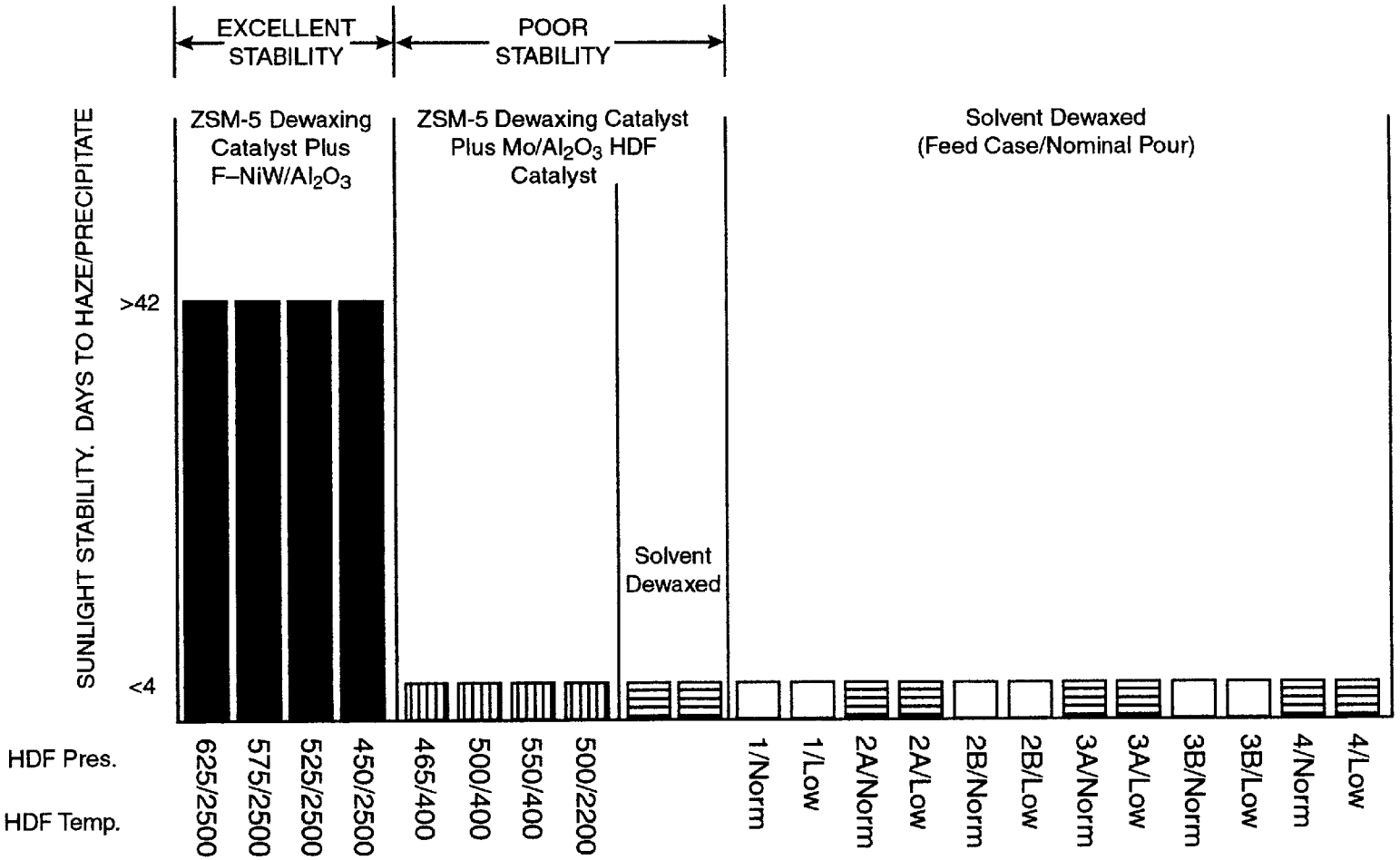
Figure 14:
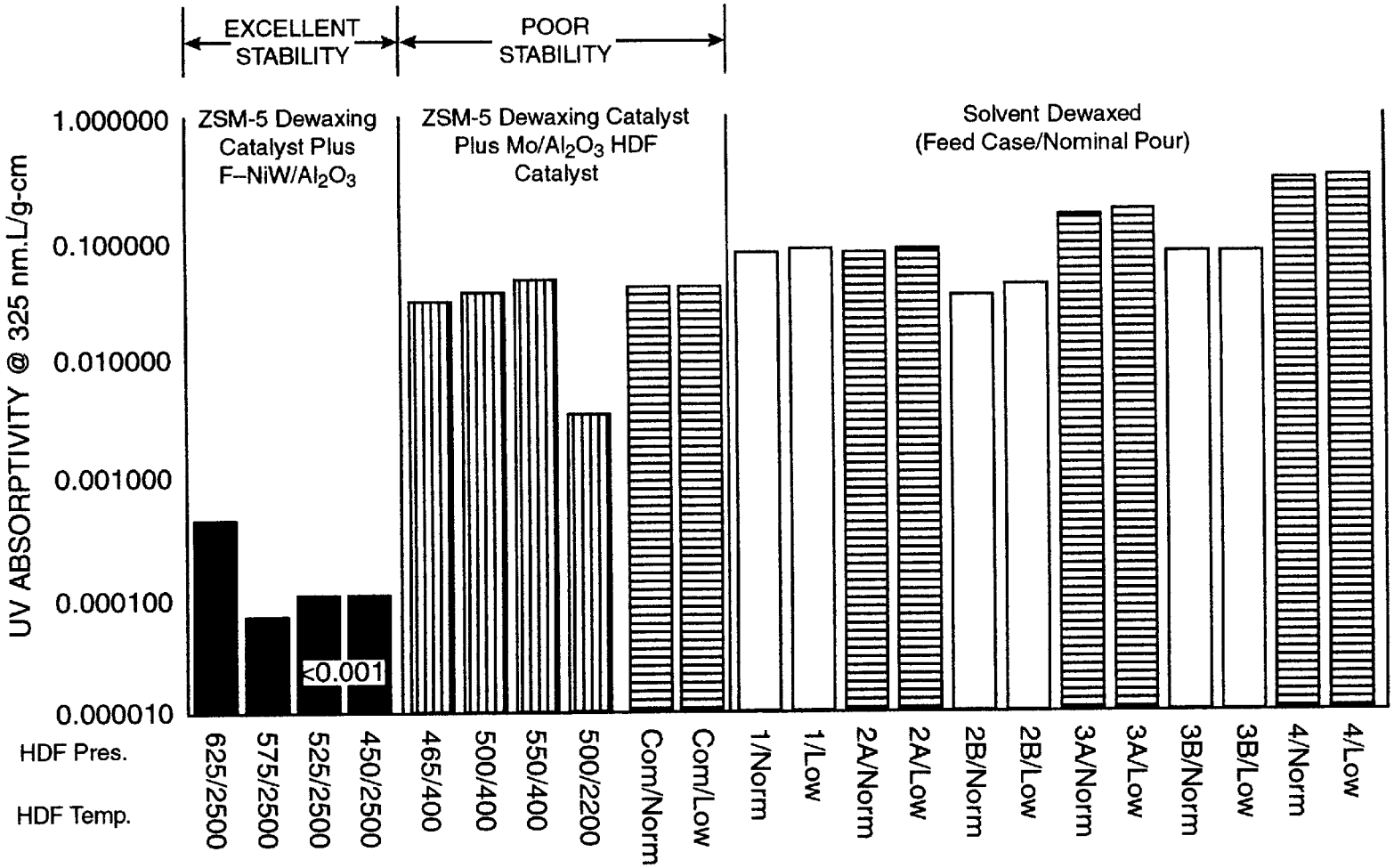

Light stability of the high pressure catalytically dewaxed and hydrotreated base stocks is excellent when the aromatic saturation catalyst is used, with no precipitate after 42 days (see FIG. 13). Products from low pressure catalytic dewaxing and hydrofinishing and also from solvent dewaxing have very poor light stability, deteriorating badly and about equally within 2–3 days. This would indicate that the light instability is not a result of anything occurring in the catalytic dewaxing step, but rather a result of unstable components in the hydrocracker bottoms. Such instability is generally associated with 3+ ring aromatics, which can be monitored by UV absorptivity at 325 nm. After absorption of light, these compounds oxidize to produce free radical chain initiators, which subsequently react with other hydrocarbons to produce carboxylic acids. In low aromatic stocks such as these, solubility of these oxidation products is low and they precipitate out.

The high pressure catalytically dewaxed and hydrofinished base stocks have UV absorptivities @ 325 nm that are several orders of magnitude below the other samples (see FIG. 12 and Table 5). Note that the standard catalytic dewaxing hydrotreating catalyst, even at 2200 psig, is not well suited for removal of these unstable compounds. The light stability results of FIG. 13 correlate with the UV results of FIG. 14.

Example 7

The RBOT testing for oxidation stability (Rotary Bomb Oxidation of Turbine Oils) followed ASTM Method D2272. It was done using the base oils plus 0.3 wt. % Irganox ML820, which is a commercially available turbine oil additive package. In the test the sample is placed in a pressure bomb along with water and a copper catalyst coil. The bomb is pressured with oxygen to 90 psi, placed in a 150° C. (302° F.) bath, and rotated axially on an incline. The number of minutes required for the pressure to drop 25 psi is reported; hence, higher results indicate superior oxidative stability. (See Table 5 and FIG. 15).

Results

Figure 15:
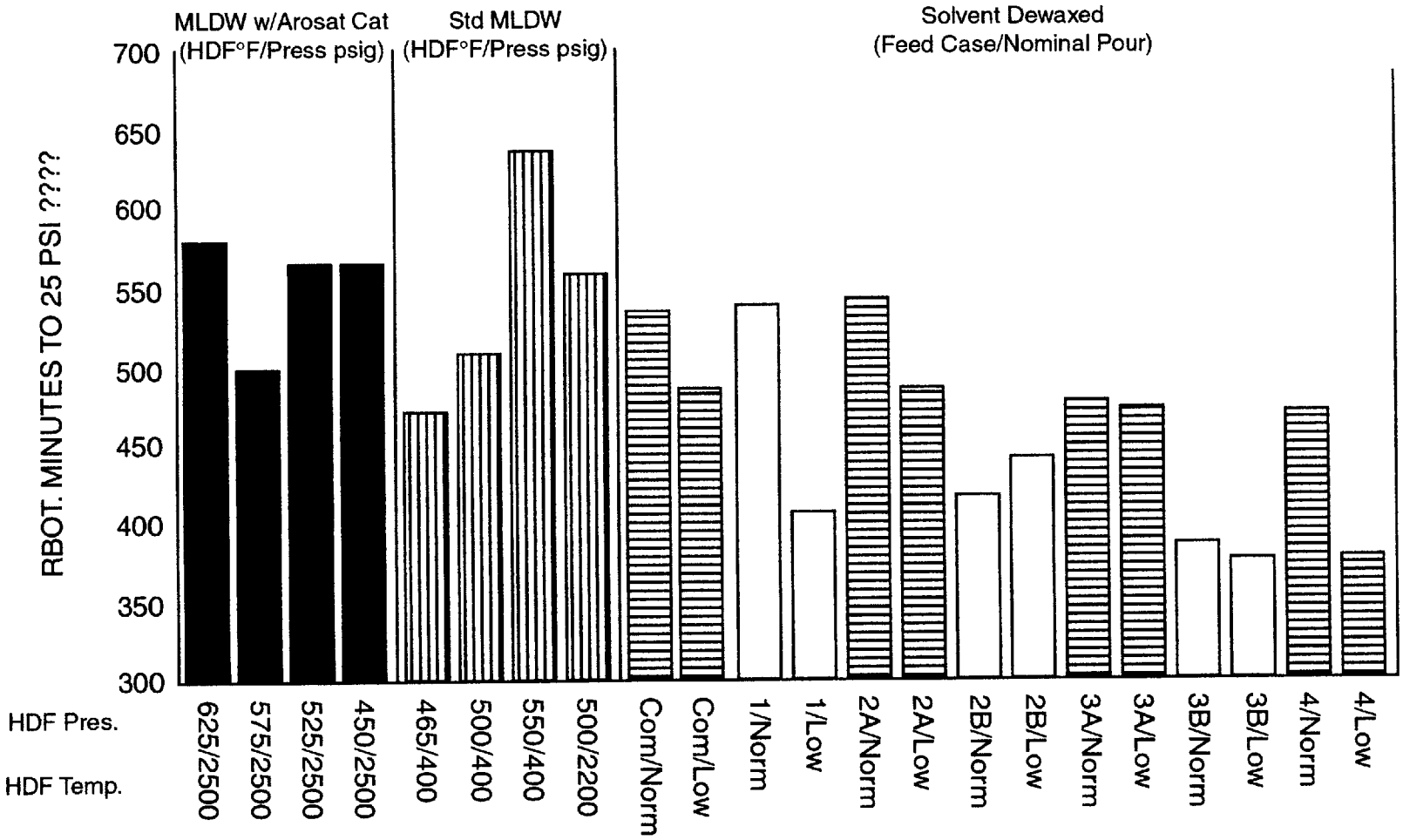

RBOT performance of high pressure catalytically dewaxed and low pressure catalytically dewaxed base stocks are comparable and good (see FIG. 15). Solvent dewaxed oils from the same commercial feed also performed well, but were marginally lower on average. Relative to the catalytically dewaxed stocks, the solvent dewaxed hydrocracked samples were fair to poor, and showed a general trend of decreasing RBOT stability with increasing boiling range (25% bottoms vs. full range hydrocrackate) and increasing hydrocracker catalyst age End of Run (EOR) vs. Start of Run (SOR).

Example 8

Table 7 illustrates via extremely low UV absorptivities at 400 nm that polynuclear aromatics (PNA) are largely absent in lubes which have been treated with high pressure catalytic dewaxing followed by hydrofinishing with an aromatics saturation catalyst. This correlates with the sunlight stability results on FIG. 13.

Example 9

Dewaxing catalyst aging is significantly lower at 2500 psig than it is at 400 psi. In addition, lube pour point is 2.3 times more responsive to dewaxing temperature changes at the higher pressure. The aging difference is attributed to lower rates of coke formation at the higher pressure.

Figure 10:
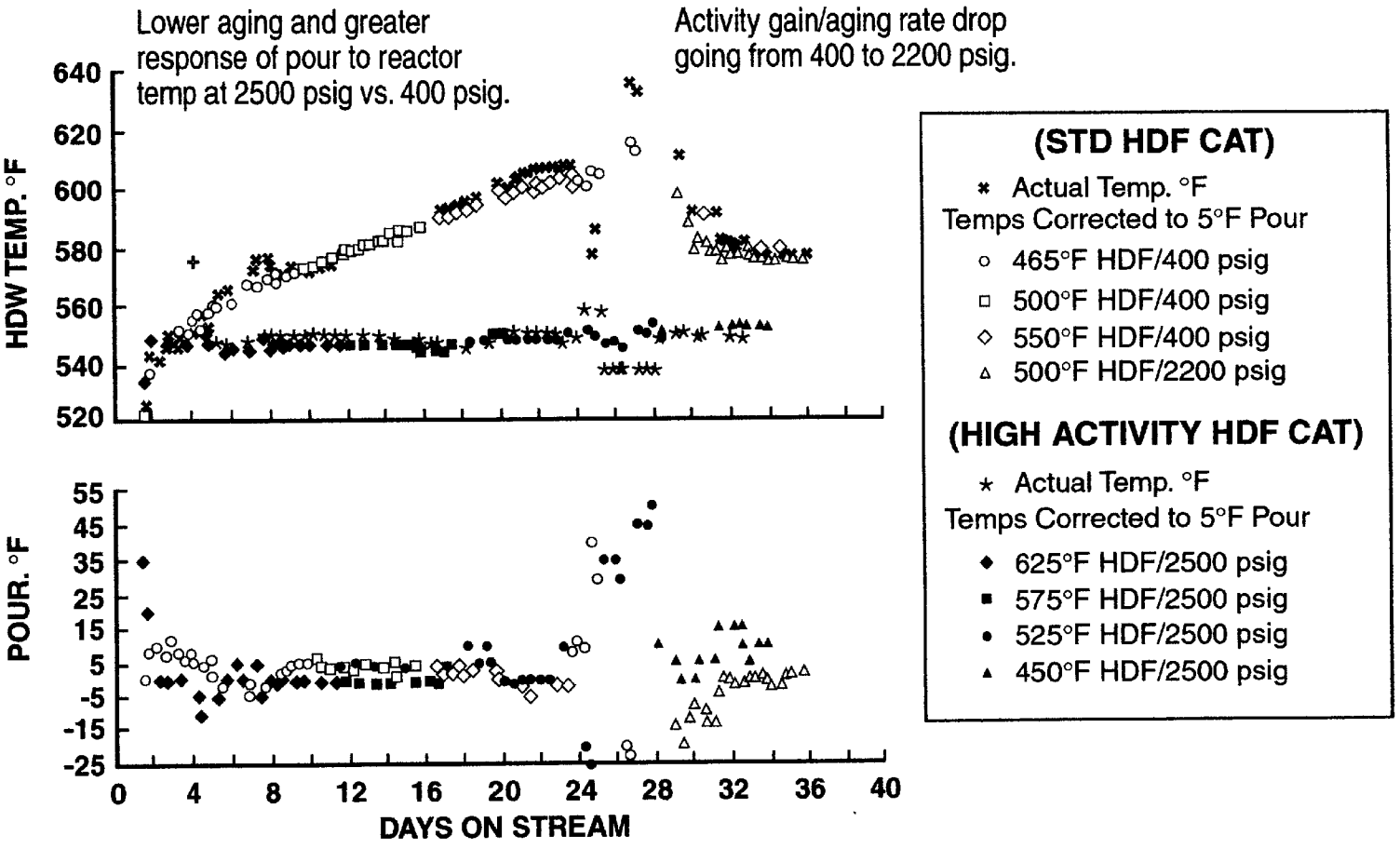
Figure 11:
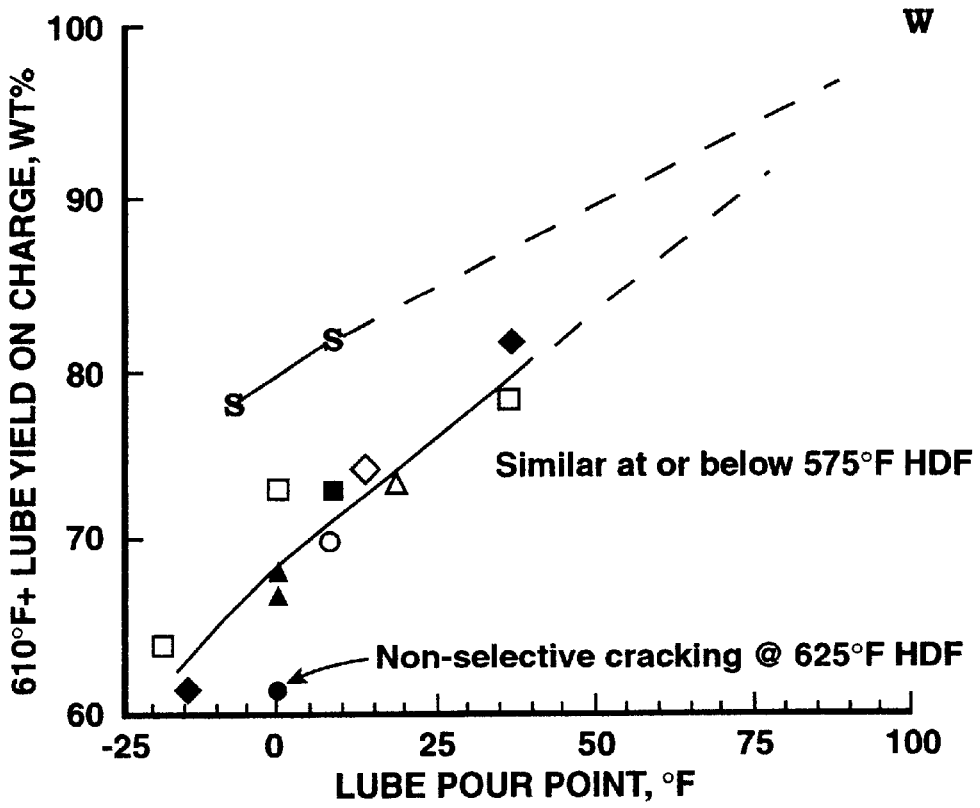

Catalyst aging is depicted in FIG. 10. Hydrodewaxing reactor (reactor 1) temperatures (actual and corrected to 5° F. pour point) and pour point are shown versus days on stream. As is typical for low nitrogen stocks, aging rates are low relative to conventional, solvent-refined stocks.

High Pressure Catalytic Dewaxing Run

At 2500 psig the catalyst lined out at 545° F. within the first two days on stream. Aging rate throughout the 36-day run was negligible. Consequently, extremely long cycle lengths are expected at 2500 psig.

Low Pressure Catalytic Dewaxing

At 400 psig, start of cycle temperature was about 530° F. Initial aging rate was 6.4° F./day with a transition to a lower aging rate of 5.65° F./day. A pour point correction of −1.3° F. pour/1° F. change in HDW reactor temperature was effective for smoothing out the HDW reactor temperature data for pour points ranging from −22° F. to +39° F.

After 29 days on stream, the pressure was increased to 2200 psi. Within 4 days, the catalyst recovered a substantial amount of its activity and the aging rate dropped to near-zero. This would suggest that the increased aging at 400 psig resulted from higher coking rates, and some of this coke is easily hydrogenated or desorbed when the pressure is increased.

Example 10

In general, increasing catalytic dewaxing operating pressure tends to reduce distillate yield and correspondingly increase $C_5$ minus yields. Lube yield is relatively insensitive to pressure. Compared to solvent dewaxing (SDW) there is about a 10 wt. % debit in lube yield at 5° F. pour point, 70–72 wt. % for catalytic dewaxing with ZSM-5 catalyst vs. 82 wt. % for solvent dewaxing (dry wax basis). However, it must be recognized that most solvent dewaxing units produce waxes that contain anywhere from 10–30% oil. Thus, actual solvent dewaxing yields are in the range of 74 to 80%.

Figure 16:
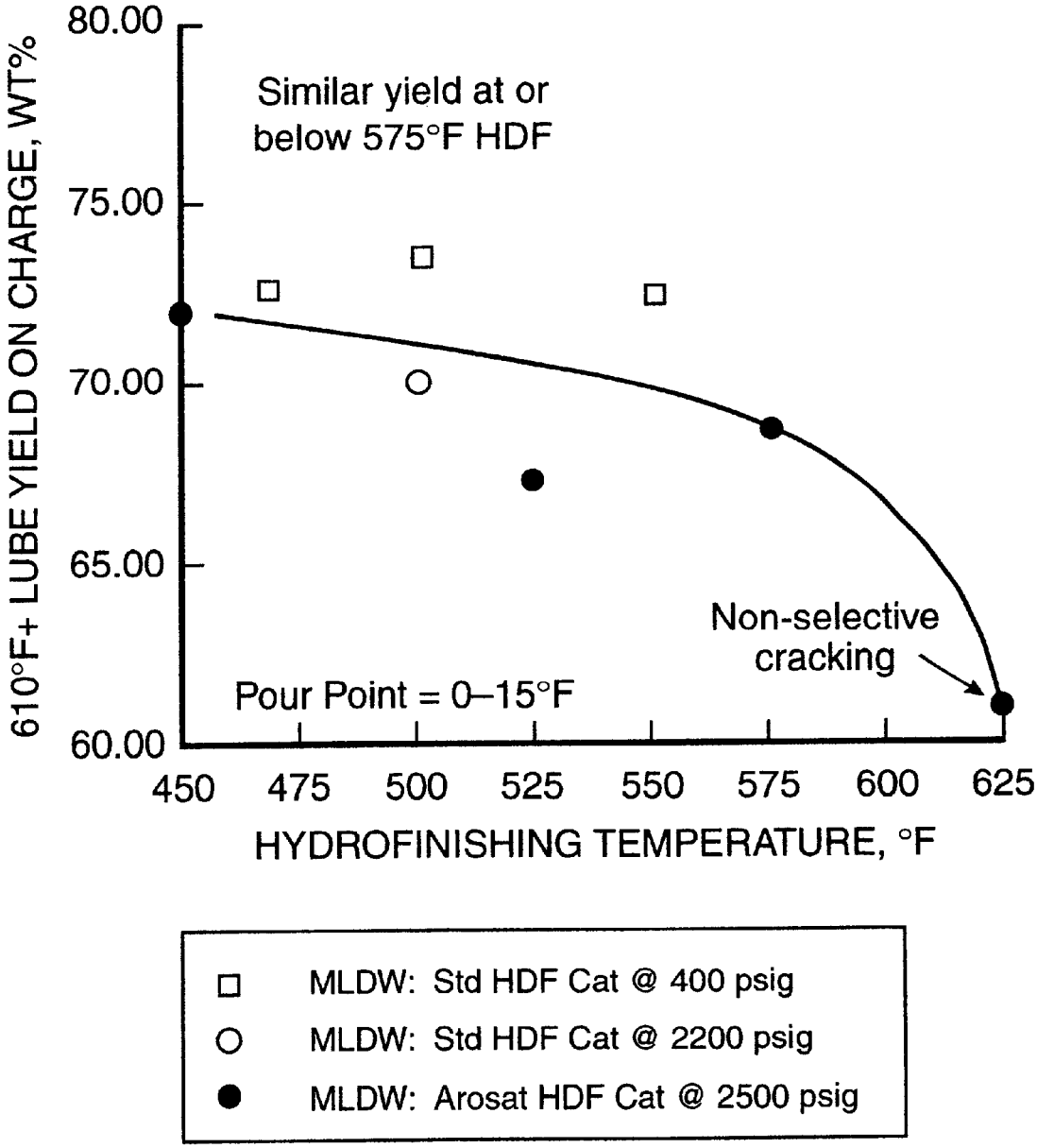
Figure 17:
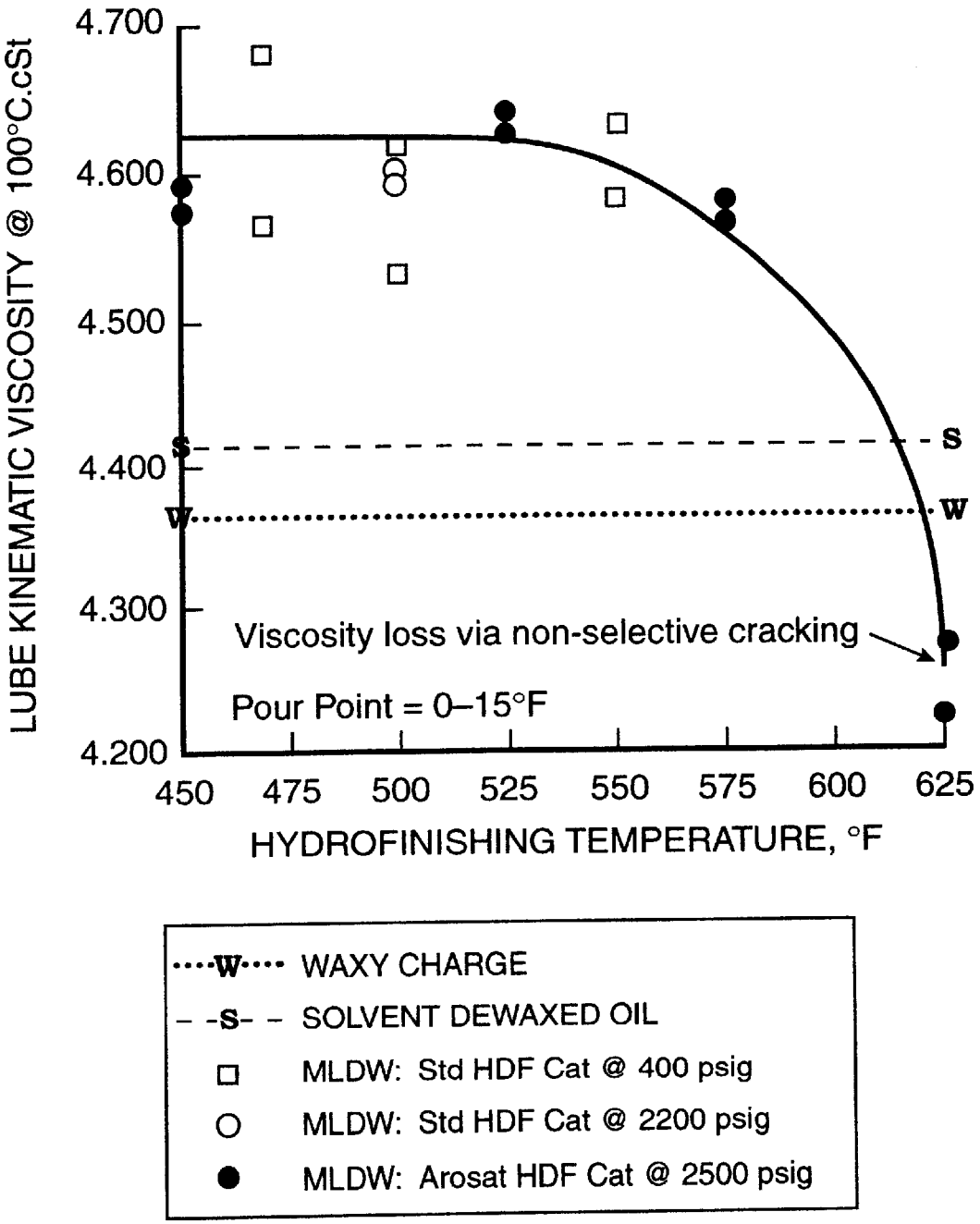

Product yield distributions indicate that there is non-selective cracking occurring over the high activity, high pressure aromatic saturating catalyst at 625° F. Lube yield drops by 6 wt. %, as shown in FIG. 16 (Lube Yield vs. Temperature) and FIG. 17 (Viscosity vs. Hydrofinishing Severity at Constant Pour Point.) Most of this loss shows up as increased distillate yield. Sudden shifts in lube properties at 625° F. hydrotreating temperature also indicate non-selective cracking.

Figure 18:
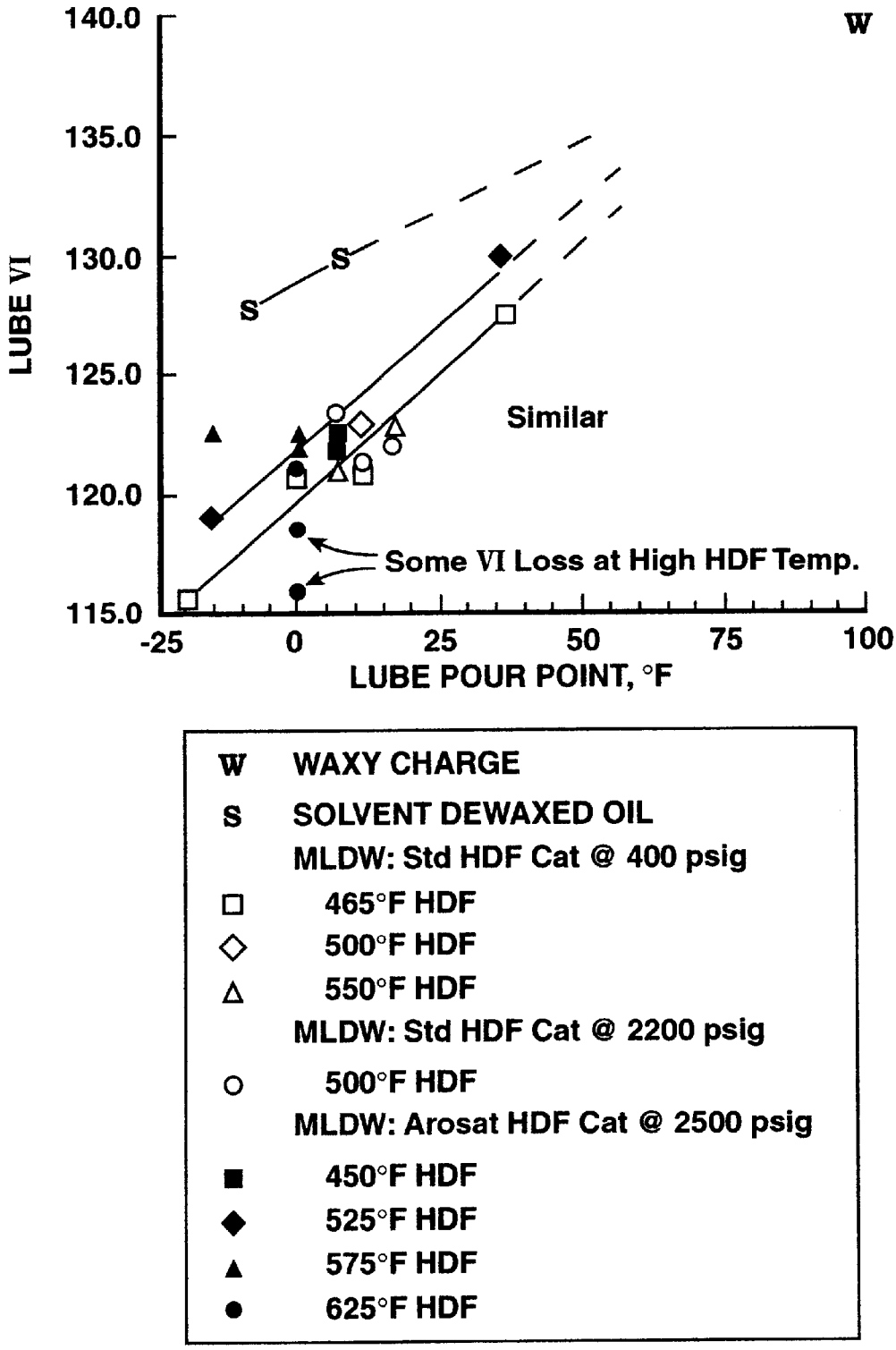

Throughout most of the hydrofinishing operating range explored, viscometric properties of both the low and high pressure catalytic dewaxing lube products are similar (FIG. 18). At 5° F. pour point, viscosity is 116 SUS @ 100° F. (4.6 cSt @ 1000C.) and VI is 121. Solvent dewaxed oil viscosities are lower and VI's are higher, which is consistent with the differences in the way that the two processes achieve their goal.

It is apparent from the lube properties and yields discussed supra that there is non-selective cracking occurring over the Arosat hydrofinishing catalyst at 625° F. Lube viscosity drops off significantly, with a corresponding 3–5 number drop in VI. (See FIGS. 17 and 18.)

Major differences between the properties of lubes made with low and high pressure catalytic dewaxing are a result of the degree of aromatics saturation in the hydrofinishing reactor—a consequence of differences in (1) the type of hydrofinishing catalyst used and (2) the hydrogen pressure.

These differences are even greater for aromatic feedstocks, e.g., deeper cut hydrocracked bottoms or end-of-cycle hydrocracked product.

Solvent dewaxing preferentially removes the heavier, higher pour waxes, whereas catalytic dewaxing with ZSM-5 preferentially cracks the smaller, normal paraffins and as a result removes more paraffins to achieve the same pour points. As a result, the catalytically dewaxed light neutral lube yields and VI's are lower. Low temperature viscometric performance of formulated catalytically dewaxed products are superior to solvent dewaxed oils of equivalent viscosity, however.

Example 11

UV absorptivity, as well as product appearance, was relied on for screening hydrofinishing reactor conditions during the pilot plant studies. Absorptivity at five wavelengths—226, 254, 275, 325, and 400 nm—are used as qualitative indicators of the amount of aromatics, with 226 nm corresponding to total aromatics. Aromatics with three or more rings and four or more rings are indicated by absorptivities at 325 nm and 400 nm, respectively. Lube aromatics arc reduced dramatically over the Arosat HDF catalyst. The standard catalytic dewaxing HDF catalyst, which is designed for olefin saturation, is much less effective, even at 2200 psig (see FIGS. 12 and 21). As seen in FIG. 12, absorptivity at 226 nm (which correlates with total aromatics) goes through a minimum for the high pressure catalytic dewaxing near 525° F.—marking the crossover from a kinetically-limited to an equilibrium-limited regime. This minimum should move toward higher HDF temperatures (and higher UV absorptivities) as feed aromatics increase. The standard catalytic dewaxing HDF catalyst is kinetically limited for saturating aromatics in the temperature range examined.

In general, saturation of polynuclear aromatics (400 nm) is relatively easy and the reaction is equilibrium limited in the normal range of hydrofinishing temperatures at high pressures, i.e., polynuclear aromatics decrease and then increase with hydrofinishing temperature. Higher hydrogen pressures shift the equilibrium to lower values.

Figure 19:
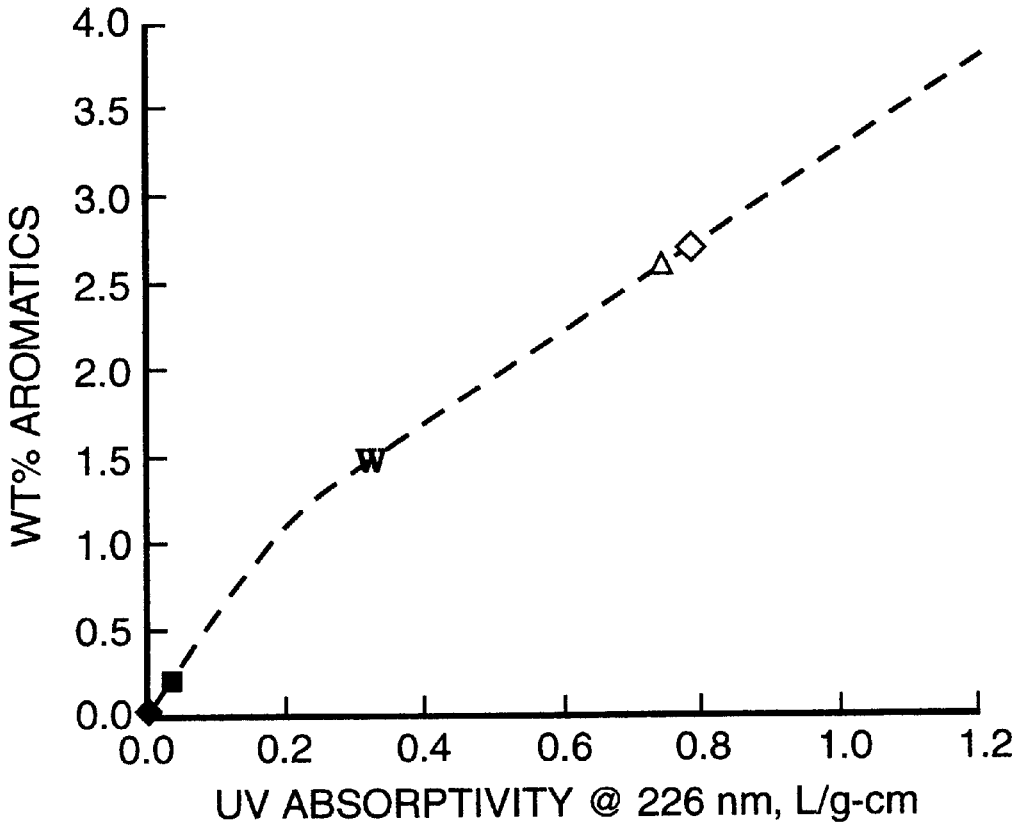
Figure 20:
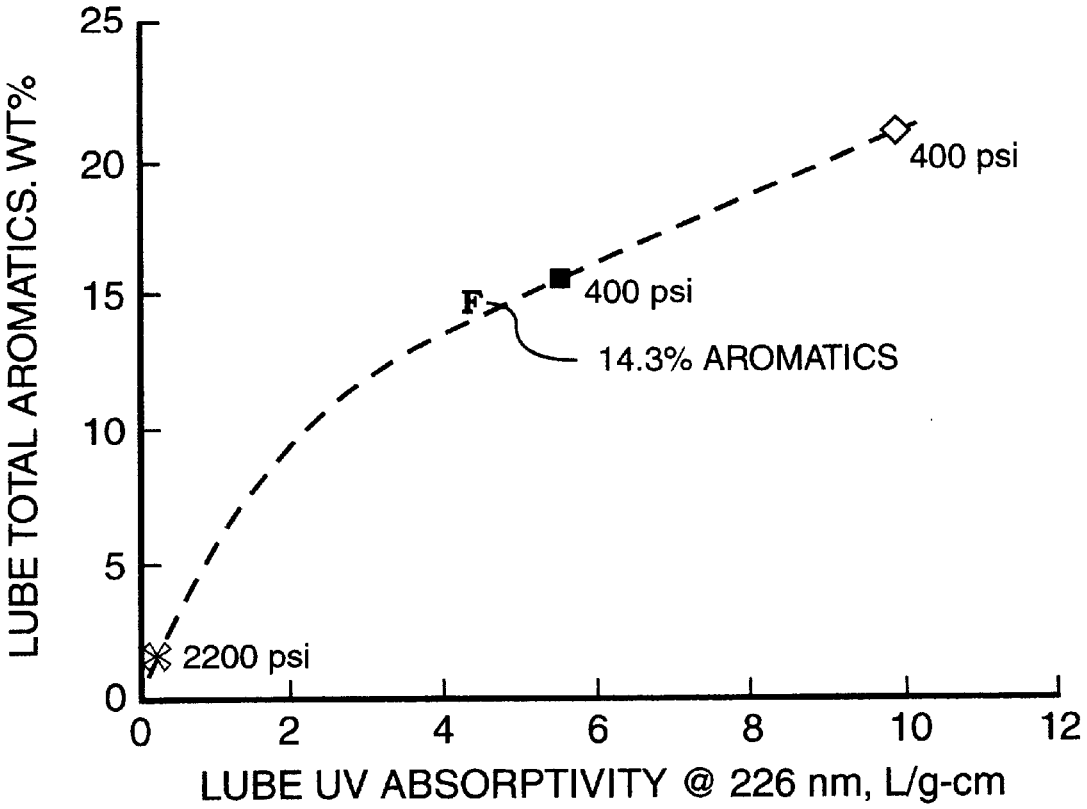

FIGS. 19 and 20 show correlations of UV absorptivity v. aromatics content for two different hydrocrackates. One had low aromatics content and the other possessed high aromatics content. The data clearly demonstrate that high pressure and aromatic saturating hydrofinishing catalyst is better than low pressure hydrofinishing with standard hydrofinishing catalyst. (See Table 8.)

TABLE 8

Comparison of Product Characteristics

| HDW Temp. ° F. | HDF Temp. ° F. | Pressure, Psig | Wt. % Aromatics in Lube (Chg = 14.3) | Lube Pour Point, ° F. | Lube Yield, Wt. % | Fractional Yield Of Aromatics (Lube Aromatics × Lube Yield)/(Charge Aromatics) |
|---|---|---|---|---|---|---|
| 602 | 425 | 400 | 15.3 | 5 | 86 | 0.9 |
| 634 | 425 | 400 | 20.7 | −50 | 76 | 1.1 |
| 623 | 425 | 2200 | 1.7 | 5 | 88 | 0.1 |

Example 13

Although many of the examples above have employed HZSM-5 as the dewaxing catalyst, other catalysts, described supra, may also be used as dewaxing catalysts. This is illustrated on FIG. 20 where the dewaxing catalyst was Pt on ZSM-23. FIG. 18 shows that lube VI and yields obtained with Pt/ZSM-23 are about the same as or better than those obtained by solvent dewaxing.

Example 14

A number of medium pore molecular sieves were tested for their abilities to convert a normal paraffin that is representative of waxes in waxy light lube oil base stocks. The normal paraffin was n-hexadecane. The molecular sieves that were tested with this compound were ZSM-5, ZSM-23, ZSM-48 and SAPO-11. The acid activity of the catalysts, as measured by the "ALPHA" test, was varied for the molecular sieves either in the synthesis of the sieve or by steaming, which is known to reduce the activity of molecular sieves. A noble metal, namely platinum, was added to each catalyst made from the molecular sieves. The platinum concentration was varied with some of the sieves. The following table lists the molecular sieves, their platinum contents and their "ALPHA" activities.

TABLE 9

Characteristics of Molecular Sieves

| Molecular Sieve | Pt, Wt. % | "Alpha" Activity | Temperature For 95% Conversion, at 0.4 LHSV F |
|---|---|---|---|
| ZSM-23 | 0.5 | 30 | 547 |
| ZSM-23 | 0.2 | 30 | 570 |
| ZSM-23 | 0.5 | 1 | 603 |
| ZSM-48 | 0.83 | 5 | 619 |
| SAPO-11 | 0.7 | 9 | 600 |
| ZSM-5 | 1.1 | 8 | 554 |
| ZSM-5 | 0.4 | 1 | 603 |
| ZSM-5 | 0.5 | 280 | 445 at 3.0 LHSV |

Figure 21:
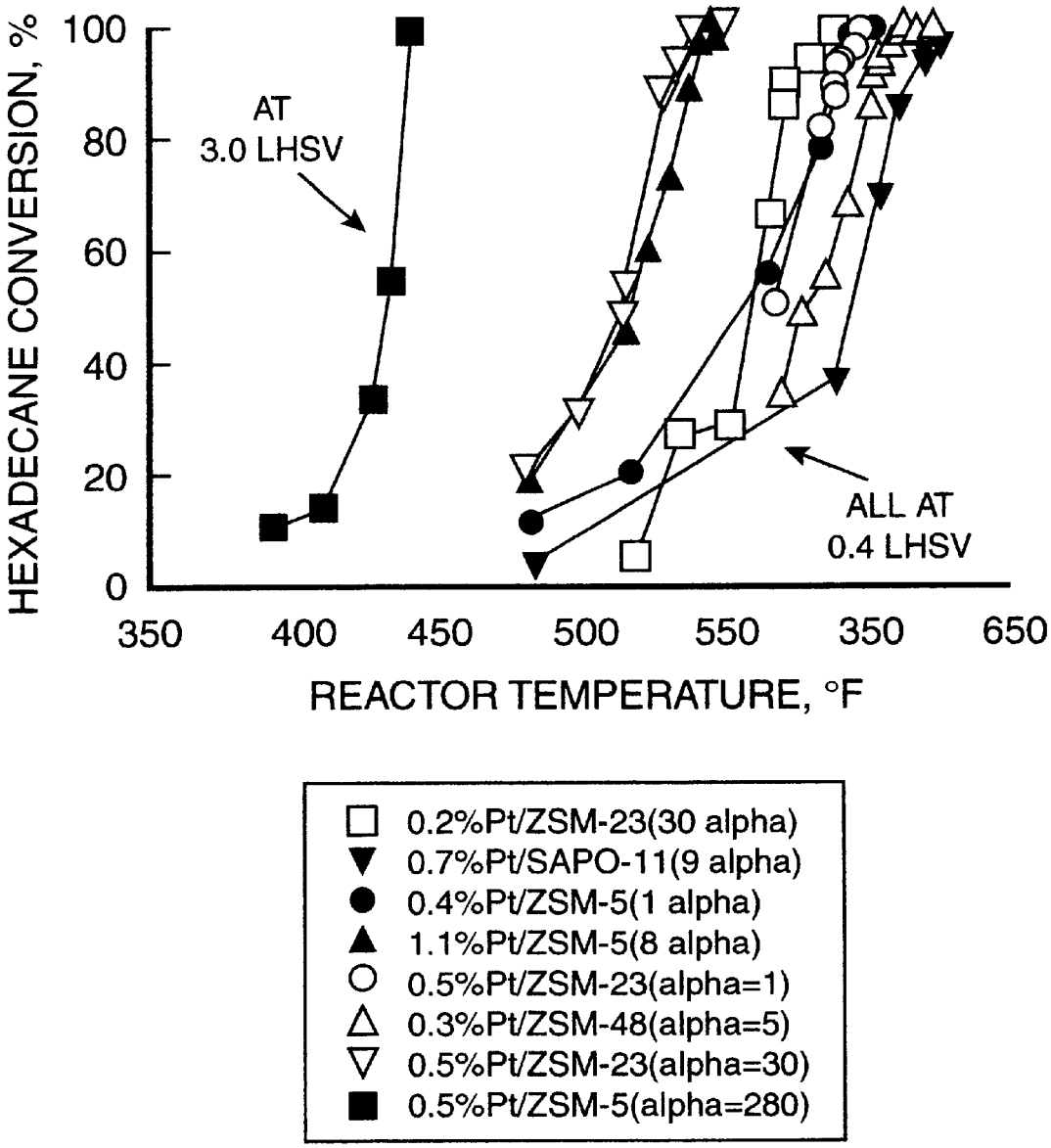
Figure 22:
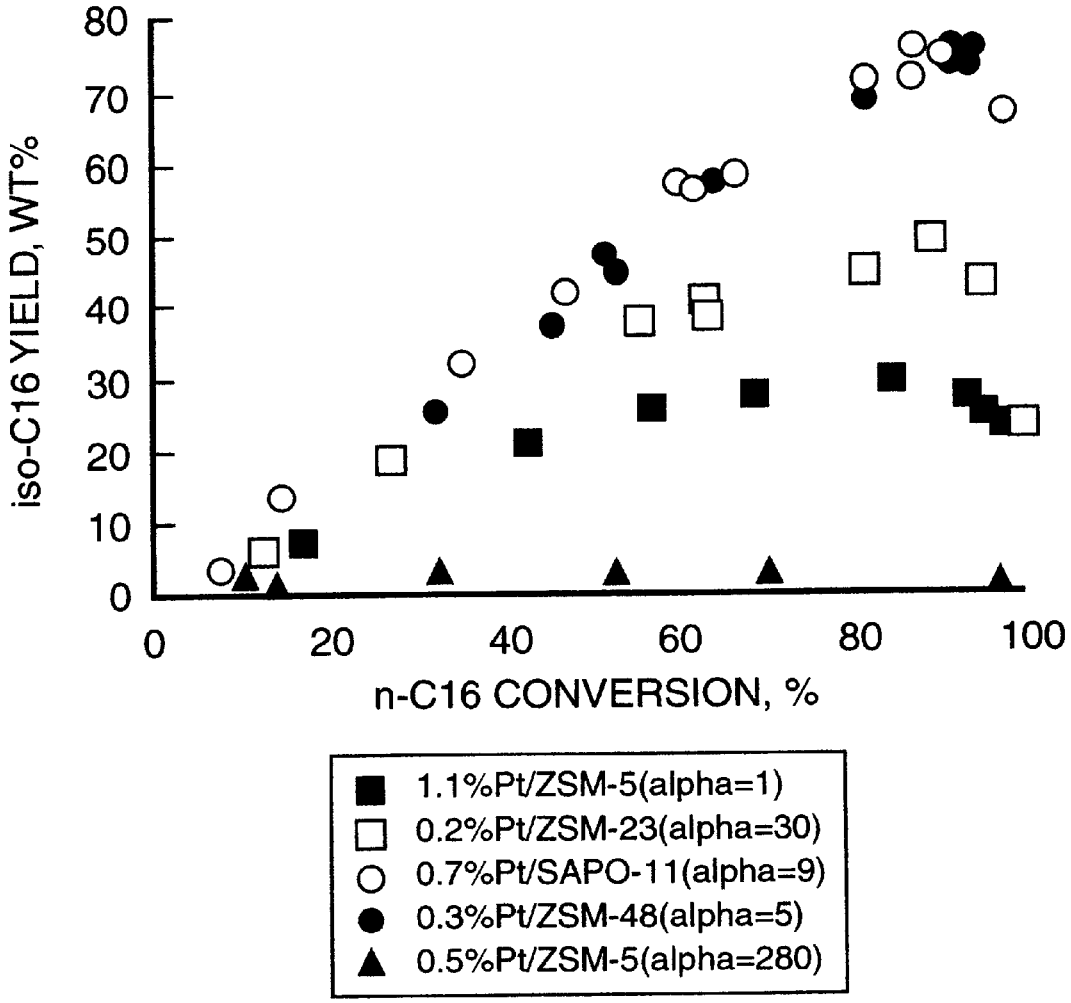
Figure 23:
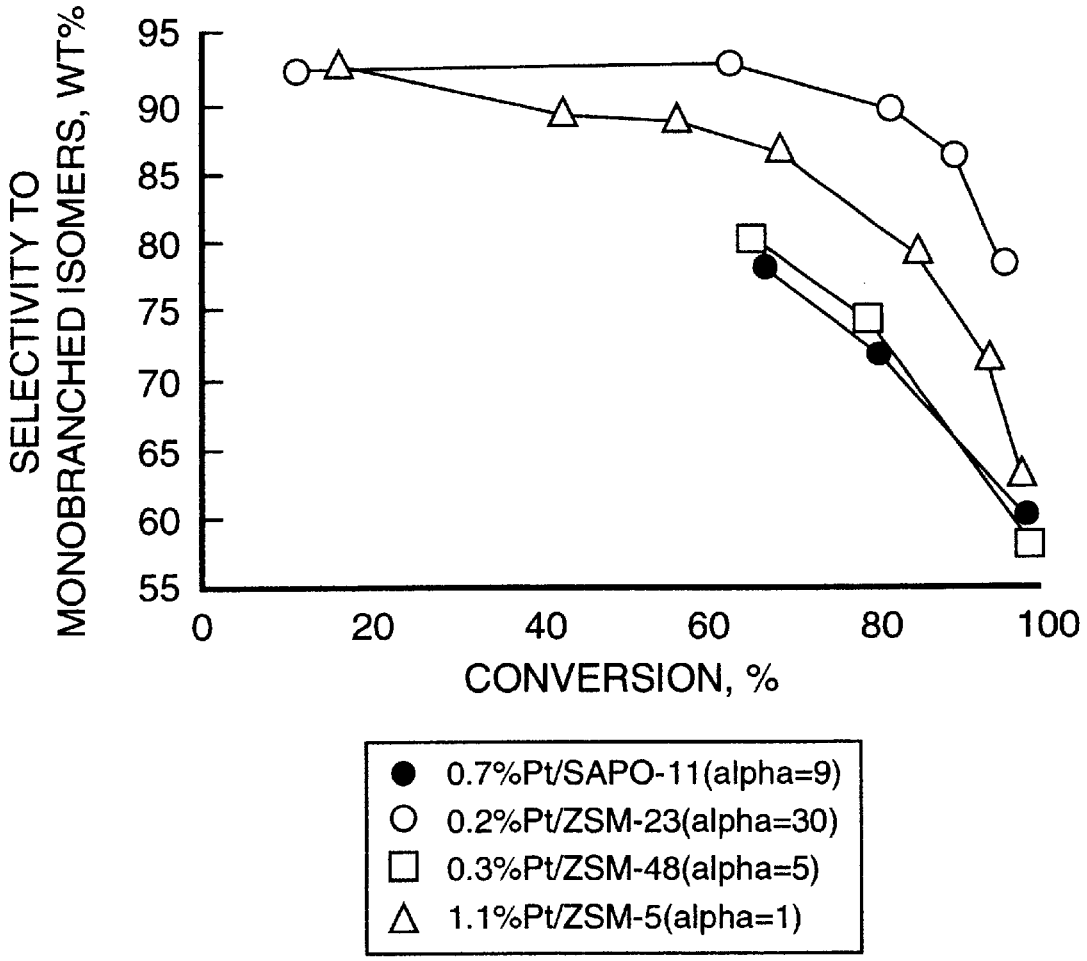
Figure 24:
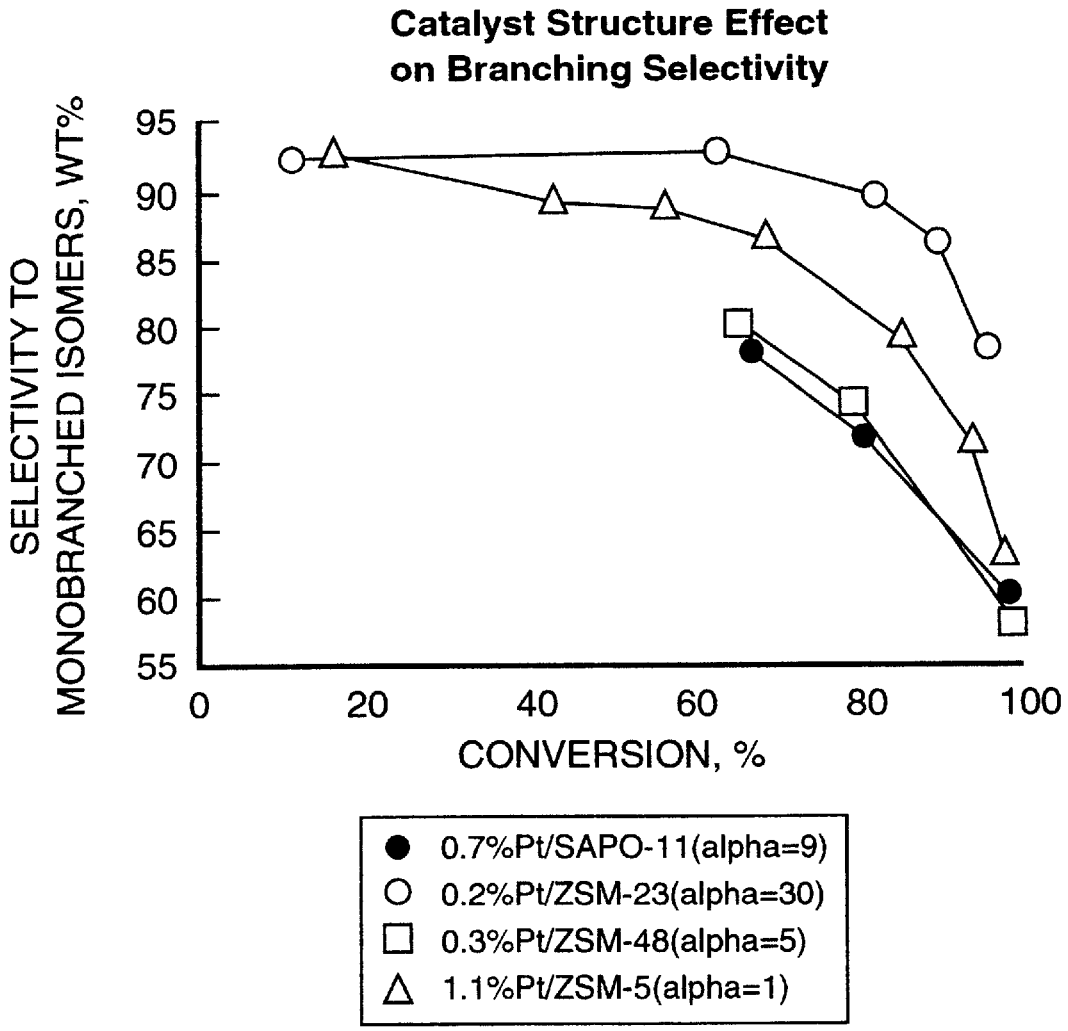

All of these medium pore molecular sieves are capable of high conversions of a waxy compound such as n-hexadecane. The activity of the catalyst made from each molecular sieve can be significantly different depending upon the activity of the molecular sieve in the catalyst. The platinum content also affects the activity. Product selectivities are affected by the type of sieve, platinum content and "ALPHA" activity. FIG. 21 is a plot of n-hexadecane conversion versus temperature requirements. FIG. 22 is a plot of the yield of isomeric n-hexadecane conversion compounds having 16 carbon atoms versus hexadecane conversion. This figure shows that ZSM-48 and SAPO-11 give the best selectivity to isoparaffins in general. If a high alpha ZSM-5 is used, the selectivity is very low. However, FIG. 23 shows that ZSM-23 gives the best selectivity to the monobranched isomers of normal hexadecane. This type of selectivity may be important in determining the VI of lubricant products. Thus, it is clear that the conversion of normal paraffins, or waxes, to isomeric compounds of the same molecular weight requires optimization of the noble metal content, and the acid activity and the pore structure of the molecular sieve for each molecular sieve used in making a finished catalyst.

What is claimed is:

1. A process for producing lubricating oils from lubricating oil feedstocks comprising the steps of:

(a) passing the feedstock to a fuels hydrocracker under hydrocracking conditions to produce a hydrocracked feedstock, wherein at least about 30 wt. % of the feedstock is converted to hydrocarbon products which boil below the initial boiling point of the feedstock;

(b) passing at least a portion of the hydrocracked feedstock to a separation zone and separating gases, a converted hydrocracked fraction containing distillates boiling up to the diesel range and an unconverted hydrocracked fraction;

(c) passing at least a portion of the unconverted hydrocracked fraction to a vacuum distillation zone and isolating at least two fractions;

(d) hydrodewaxing the at least two fractions from the vacuum distillation zone in a catalytic dewaxing zone under catalytic dewaxing conditions to produce at least two dewaxed fractions, wherein the catalytic dewaxing conditions include a shape selective, medium pore molecular sieve catalyst; and (e) hydrofinishing the at least two dewaxed fractions in a hydrofinishing zone under hydrofinishing conditions, said hydrofinishing zone including an aromatics saturation catalyst having metal hydrogenation function, to produce lubricating oils.

2. The process of claim 1, wherein the hydrocracking feedstock has a 10% distillation point greater than 345° C.

3. The process of claim 1 wherein the feedstock is passed to a hydrotreating zone prior to passing to the fuels hydrocracker and hydrotreated under hydrotreating conditions to produce a hydrotreated feedstock.

4. The process of claim 3 wherein the hydrotreating zone comprises a hydrotreating catalyst and temperatures of from 250 to 450° C., hydrogen partial pressures of from 800 to 3000 psia, space velocities of from 0.1 to 10 LHSV, and hydrogen treat gas rates of from 500 to 10000 scf/bbl.

5. The process of claim 1 wherein the hydrocracking conditions comprise a hydrocracking catalyst and temperatures of from 315 to 425° C., hydrogen partial pressures of from 1200 to 3000 psia, space velocities of 0.1 to 10 LHSV, and hydrogen treat gas rates of 2000 to 10000 scf/bbl.

6. The process of claim 1, wherein the separation zone comprises a separator and a fractionator.

7. The process of claim 1 wherein the fractions from the vacuum distillation zone comprises at least one distillate fraction and a bottoms fraction.

8. The process of claim 7 wherein the distillate fraction has a viscosity of about a 60N base oil.

9. The process of claim 8 wherein the about 60N basestock is hydrotreated prior to dewaxing.

10. The process of claim 1 wherein the catalytic dewaxing conditions include temperatures of from 205 to 400° C., hydrogen partial pressures of from 400 to 3000 psia, space velocities of from 0.25 to 5 LHSV and hydrogen treat gas rates of from 1000 to 8000 scf/bbl.

11. The process of claim 1 wherein the catalytic dewaxing conditions include a dewaxing catalyst which is a 10 ring, intermediate pore molecular sieve.

12. The process of claim 11 wherein the molecular sieve is selected from ZSM-5, ZSM-22, ZSM-23, ZSM-35, ZSM-48, ZSM-57, MCM-22, SAPO-11 and SAPO-41.

13. The process of claim 11 wherein the dewaxing catalyst contains at least one noble metal.

14. The process of claim 11 wherein the molecular sieve material is loaded with from about 0.1 to 1.2 wt. % noble metal.

15. The process of claim 1 wherein the aromatics saturation catalyst comprises at least one Group VIIIA and at least one Group VIA metal (IUPAC) on a porous solid support.

16. The process of claim 1 wherein the dewaxing zone and hydrofinishing zone are operated at substantially the same pressure, and wherein the dewaxed fraction from the dewaxing zone is passed directly to the hydrofinishing zone.

17. The process of claim 1 wherein the dewaxing zone comprises at least two catalyst beds.

18. The process of claim 1, wherein the lubricating oil product boils above about 370° C., possesses a KV in the range of 2 to 10 cSt at 100° C., an aromatics content less than 10 wt. %, and is UV light stable.

19. The process of claim 18, wherein the lubricating oil product exhibits UV light stability after exposure to sunlight and ambient air for 10 days.

20. The process of claim 1, wherein the lubricating oil product has a pour point in the range from −50° C. to −4° C.

21. The process of claim 3 wherein the hydrotreated feedstock is passed directly to the hydrocracker without disengagement provided that hydrocracker catalyst can tolerate an environment containing ammonia and hydrogen sulfide.

22. The process of claim 3 wherein the hydrotreated feedstock is passed to an initial separation zone to separate gases and light conversion products prior to passing to the hydrocracker.

23. The process of claim 1 wherein at least a portion of the unconverted hydrocracked fraction is recycled to the feedstock to the hydrotreating zone.

24. The process of claim 15 wherein the aromatics saturation catalyst contains at least one noble metal.

25. The process of claim 4 wherein the hydrotreating catalyst is a bulk metal catalyst having at least 30 wt. % of the catalyst is metal.

26. The process of claim 25 wherein the hydrotreating catalyst is a bulk metal catalyst having at least 50 wt. % of the catalyst is metal.

* * * * *